US006564731B2

(12) United States Patent
Sano et al.

(10) Patent No.: US 6,564,731 B2
(45) Date of Patent: May 20, 2003

(54) SEWING MACHINE HAVING A THREADING DEVICE

(75) Inventors: Yasuro Sano, Tokyo (JP); Eiji Murakami, Tokyo (JP); Koshiro Omiya, Tokyo (JP)

(73) Assignee: Janome Sewing Machine Co., Ltd., Tokyo (JP)

( * ) Notice: Subject to any disclaimer, the term of this patent is extended or adjusted under 35 U.S.C. 154(b) by 0 days.

(21) Appl. No.: 09/919,618

(22) Filed: Aug. 1, 2001

(65) Prior Publication Data

US 2002/0073904 A1 Jun. 20, 2002

(30) Foreign Application Priority Data

Aug. 3, 2000 (JP) ..... 2000-236292
Nov. 30, 2000 (JP) ..... 2000-366159

(51) Int. Cl.[7] ..... D05B 87/02
(52) U.S. Cl. ..... 112/225
(58) Field of Search ..... 112/222, 224, 112/225; 223/99

(56) References Cited

U.S. PATENT DOCUMENTS 5,086,718 A * 2/1992 Ogawa ..... 112/225
5,086,719 A * 2/1992 Ogawa ..... 112/221
5,090,345 A * 2/1992 Ogawa ..... 112/225

* cited by examiner

*Primary Examiner*—Ismael Izaguirre
(74) *Attorney, Agent, or Firm*—Lowe Hauptman Gilman & Berner, LLP

(57) ABSTRACT

A sewing machine having a threading device is disclosed. The sewing machine comprises a needle bar having a needle attached to a lower end thereof. The needle has a needle eye and a threading shaft has a threading member mounted to the lower end thereof. The threading member has a threading hook, a drive motor for vertically moving the threading shaft along the needle bar, guide means for guiding and rotating the threading shaft at a threading position as the threading shaft is vertically moved, and a regulating member for deciding the threading position of the threading shaft. The threading shaft is moved down and stopped at the threading position and is axially rotated to pass the threading hook through the needle eye. The threading shaft is maintained in this state until a return signal is given such that the drive motor is driven again to pull the threading hook out of the needle eye and move up the threading shaft.

14 Claims, 14 Drawing Sheets

①Insert the thread into the guide on the needle bar.

②Lead the thread to the right side guide of threading member.

③Lead the thread to the left side guide of threading member.

④Insert the thread into the guide of threading member.

⑤Cut the thread with the cutter.

⑥The threading member is turned back.

⑦The threading member is moved up.

⑧The threading member is moved up.

SEWING MACHINE HAVING A THREADING DEVICE

BACKGROUND OF THE INVENTION AND RELATED ART STATEMENT

1. Field of the Invention

The present invention relates to a sewing machine, and more particularly relates to a threading device provided in connection with the sewing machine and including a threading member having a hook and vertically moved by a drive motor along a needle bar of the sewing machine. The threading member is moved down to a threading position and is then rotated to insert the hook through the needle eye of the needle which is attached to the lower end of the needle bar, wherein a series of threading operations may be smoothly and accurately.

2. Prior Art

Recently many sewing machines have come to be provided with a threading device. Various types of threading devices have been developed, and many of which include a threading member which is moved down near the needle eye of the needle and is then a hook is inserted through the needle eye. The series of threading operations are performed manually by manipulation of a lever.

Therefore, according to the prior art, it is required that the manually operated lever is held by hand until the thread is passed through the needle eye. In this case, the timing to release the lever or the force applied to the lever is inappropriate, the thread fails to pass through the needle eye. Further, the hook is often knocked against the needle instead of being inserted into the needle eye, and both may be damaged.

OBJECTS OF THE INVENTION

It is, therefore, a primary object of the invention to provide a threading device for a sewing machine which is compact in structure and smooth in operation.

It is another object of the invention to provide a threading device which is operated automatically by a drive motor such that a thread may be rapidly and accurately passed through the needle eye of needle irrespectively of the experience of the machine operator.

It is another object of the invention to provide a drive motor which may be controlled to pull a threading hook out of the needle eye at a higher speed than the speed at the time of inserting the threading hook through so that the thread hung to the inserted hook may not be slipped out.

It is another object of the invention to provide a drive motor which may be controlled to maintain the threading hook as it is inserted through the needle eye until a return signal is given.

It is another object of the invention to provide a drive motor which may be stopped to stop the operation of the threading device in case a trouble including an excessive load is detected during threading operation.

It is another object of the invention to provide a means for indicating a warm in case a trouble is produced.

It is another object of the invention to provide a cutter for cutting the thread passed through the needle eye with a predetermined length of thread remained that is sufficient enough to form the subsequent stitch without being pulled out of the needle eye.

The other objects and advantages of the invention will be apparent in the detailed description of the invention.

SUMMARY OF THE INVENTION

For attaining the objects, the invention substantially comprises a needle bar having a needle attached to the lower end thereof, the needle having a needle eye, a threading shaft having a threading member mounted to the lower end thereof, the threading member having a threading hook, a drive motor for vertically moving the threading shaft along the needle bar, guide means for guiding and rotating the threading shaft at a threading position as the same is vertically moved, a regulating member for deciding the threading position of the threading shaft, wherein the threading shaft is moved down and stopped at the threading position and is axially rotated to pass the threading hook through the needle eye and is maintained in this state until a return signal is given such that the drive motor may be driven again to pull the threading hook out of the needle eye and move up the threading shaft.

(*a*) is a perspective view of a threading device according to the invention.

(*b*) is same with (*a*), but is shown with a drive portion removed.

FIG. 2

(*a*) is a front elevations view of the threading device, wherein a threading shaft is in the upper inoperative position.

(*b*) is a side elevational view of the threading device shown partly in vertical section.

Figure 3:
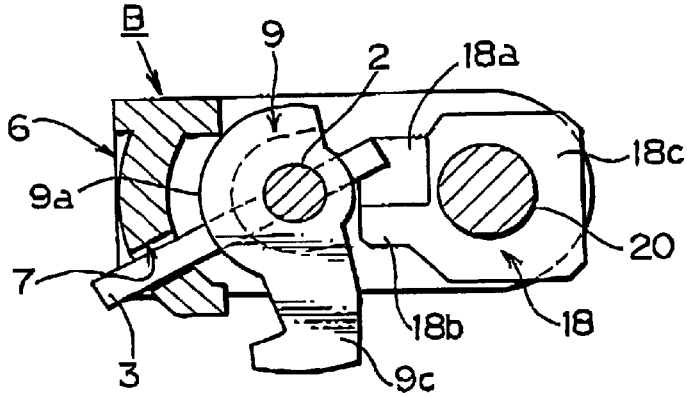

FIG. 3 is a plan elevational view of the essential parts of the threading device shown partly in horizontal section.

Figure 4:
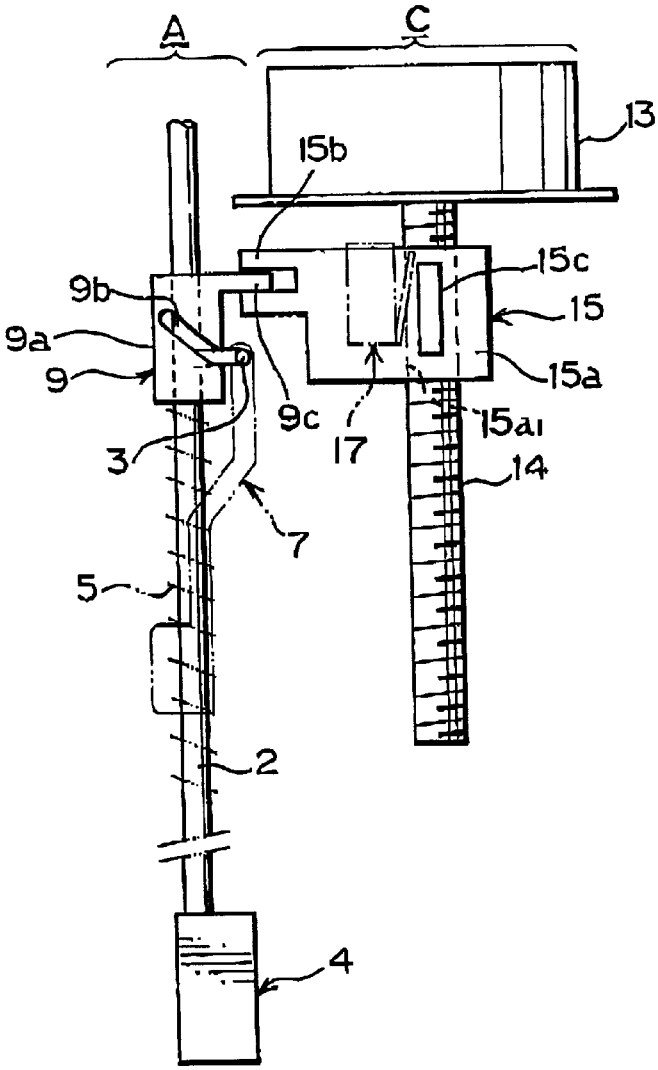

FIG. 4 is a side elevational view of the essential parts of the threading device.

FIG. 5

(*a*) and (*b*) are perspective views respectively of the essential parts of the threading device.

(*c*) is a plan elevational view of the essential parts of the threading device shown partly in horizontal section.

FIG. 6

(*a*) is a side elevational view of the essential parts of the threading device shown partly in vertical section.

(*b*) is a rear side view of (*a*).

FIG. 7

(*a*) and (*b*) are front elevational views respectively of the essential parts of the threading device showing the operation thereof shown partly cut out to show the inside thereof.

FIG. 8

(*a*) is a front elevational view of the essential parts of the threading device showing a phase of operation thereof.

(*b*) is a plan elevational view of the essential part of the threading device shown partly in horizontal section showing a phase of operation thereof.

(*c*) is a plan elevational view of the essential parts of the threading device showing a phase of operation thereof.

FIG. 9

Figure 8:
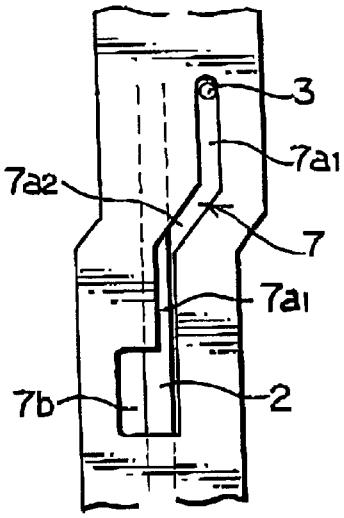
Figure 8:
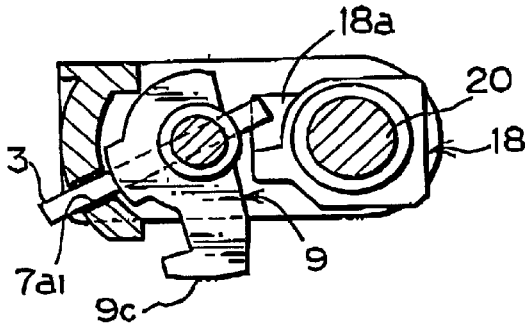
Figure 8:
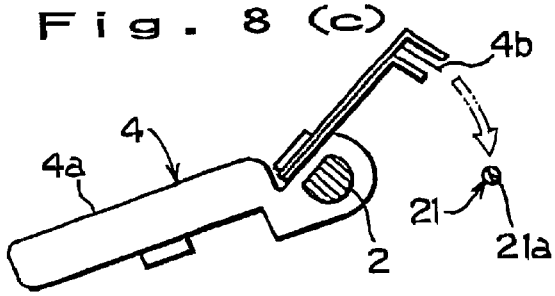

(*a*), (*b*) and (*c*) are same with FIGS. 8(*a*), (*b*) and (*c*) respectively but showing another phase of operation thereof.

FIG. 10

Figure 9:
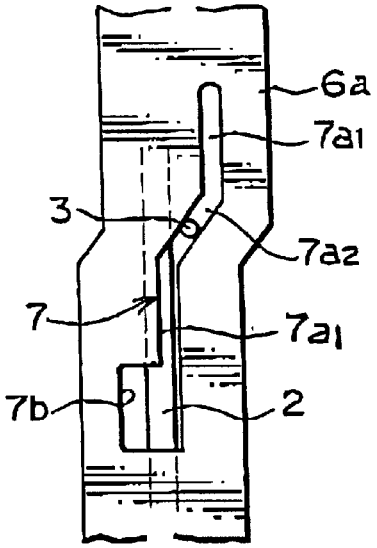
Figure 9:
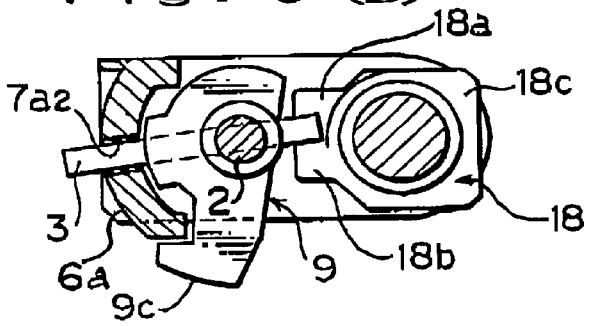
Figure 9:
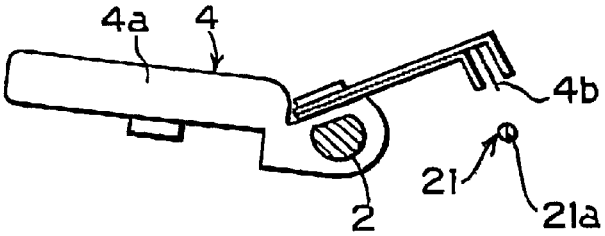

(*a*), (*b*) and (*c*) are same with FIGS. 9(*a*), (*b*) and (*c*) respectively but showing another phase of operation thereof.

FIG. 11

(*a*) is a perspective view of the threading device showing the operation thereof.

(*b*), (*c*) and (*d*) are side elevational views respectively of the threading device shown partly in vertical section and showing a series of operation phases thereof.

FIG. 12

(*a*), (*b*) and (*c*) are front elevational views respectively of the threading device showing a series of operation phases thereof.

FIG. 13

(*a*) is a perspective view of the threading device showing a phase of operation thereof.

(*b*) is an enlarged perspective view of a part of (*a*).

FIG. 14

(*a*) is a perspective view of a sewing machine having the threading device incorporated therein.

(*b*) is an enlarged front elevational view of an essential part of the threading device.

FIG. 15

① through ③ are perspective views respectively of the essential parts of the threading device showing a series of operations thereof.

FIG. 16

Figure 15:
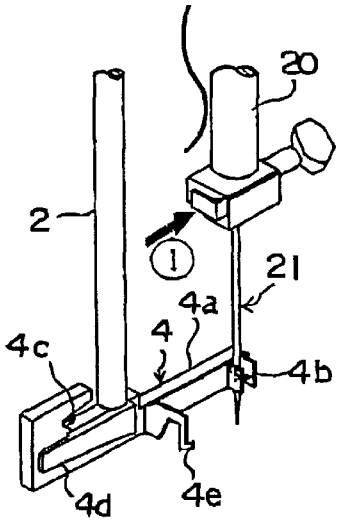
Figure 15:
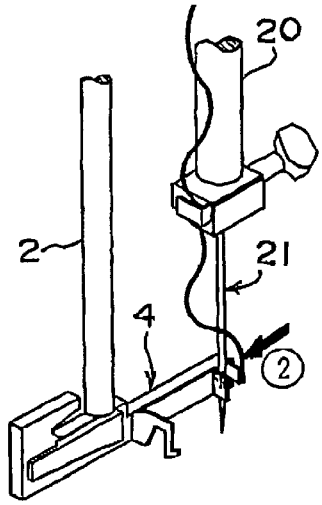
Figure 15:
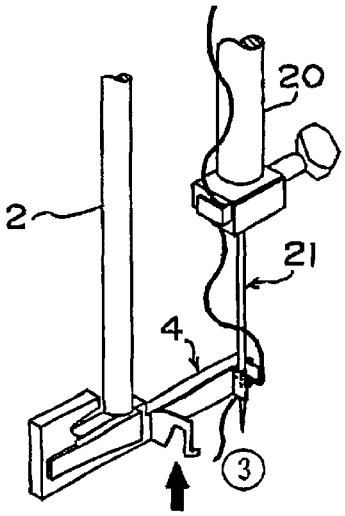
Figure 15:
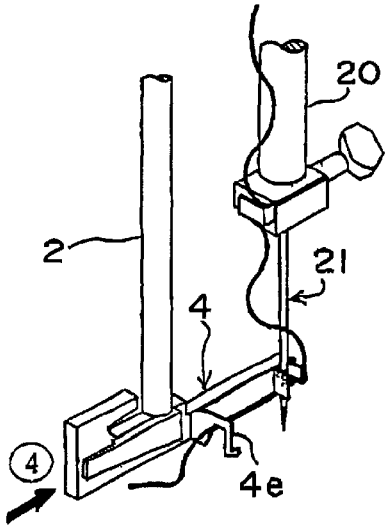

⑤ through are same with FIGS. 15 ① through ④ but showing smother series of operation phases thereof.

FIG. 17

(*a*) is a side elevational view of another embodiment of the threading device according to the invention shown partly in vertical section.

(*b*) through (*d*) are side elevational views respectively of a part of (*a*) showing a series of operation phases thereof.

DETAILED DESCRIPTION OF PREFERRED EMBODIMENTS

Figure 1:
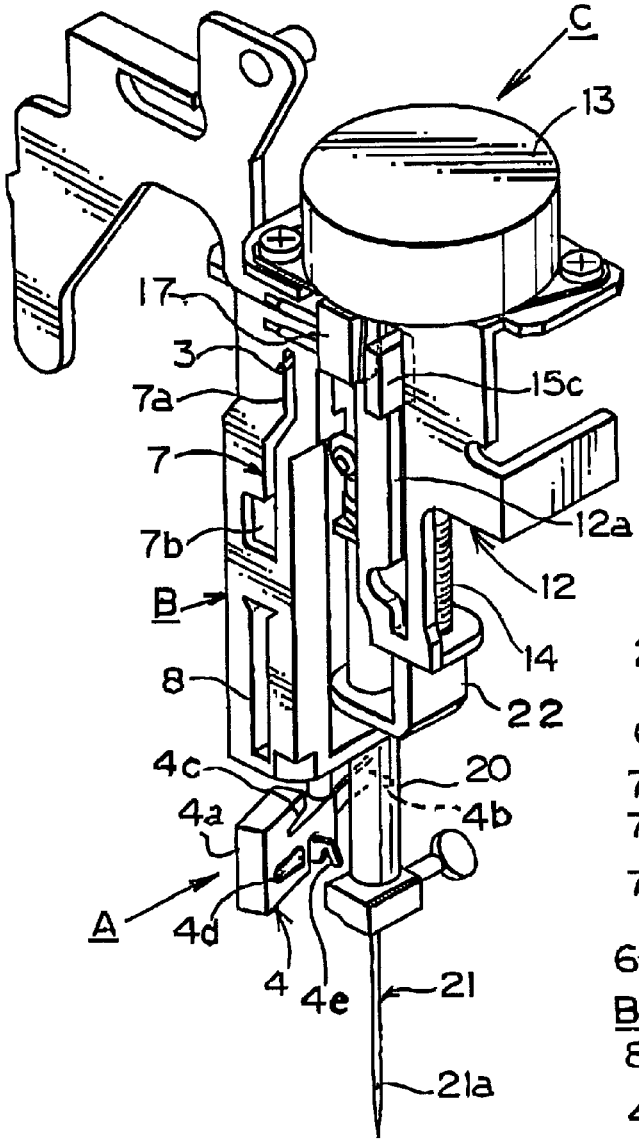
FIG. 1
Figure 1:
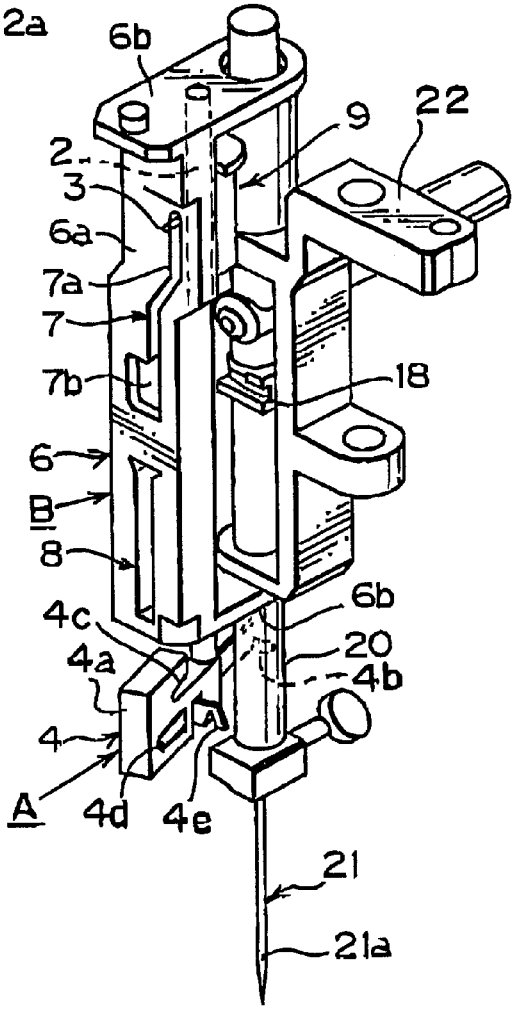

The invention will be described in detail in reference to the preferred embodiments as shown in the attached drawings. As shown in FIGS. 1(*a*), (*b*) and FIGS. 2(*a*), (*b*), the subject matter of the invention substantially composed of a threading portion A, a support portion B and an up-down drive portion C. The threading portion A is supported on the support portion B which is mounted to a needle support frame 22 of a sewing machine (not shown). The threading portion A includes a threading shaft 2, a guide pin 3 and a threading member 4 having a threading hook 4*b*. The invention further includes a sensor for detecting a lower stop position of the threading member 4 and a rotary means for inserting the threading hook 4*b* into a needle eye 21*a* of a needle 21 attached to the lower end of a needle bar 20.

Figure 2:
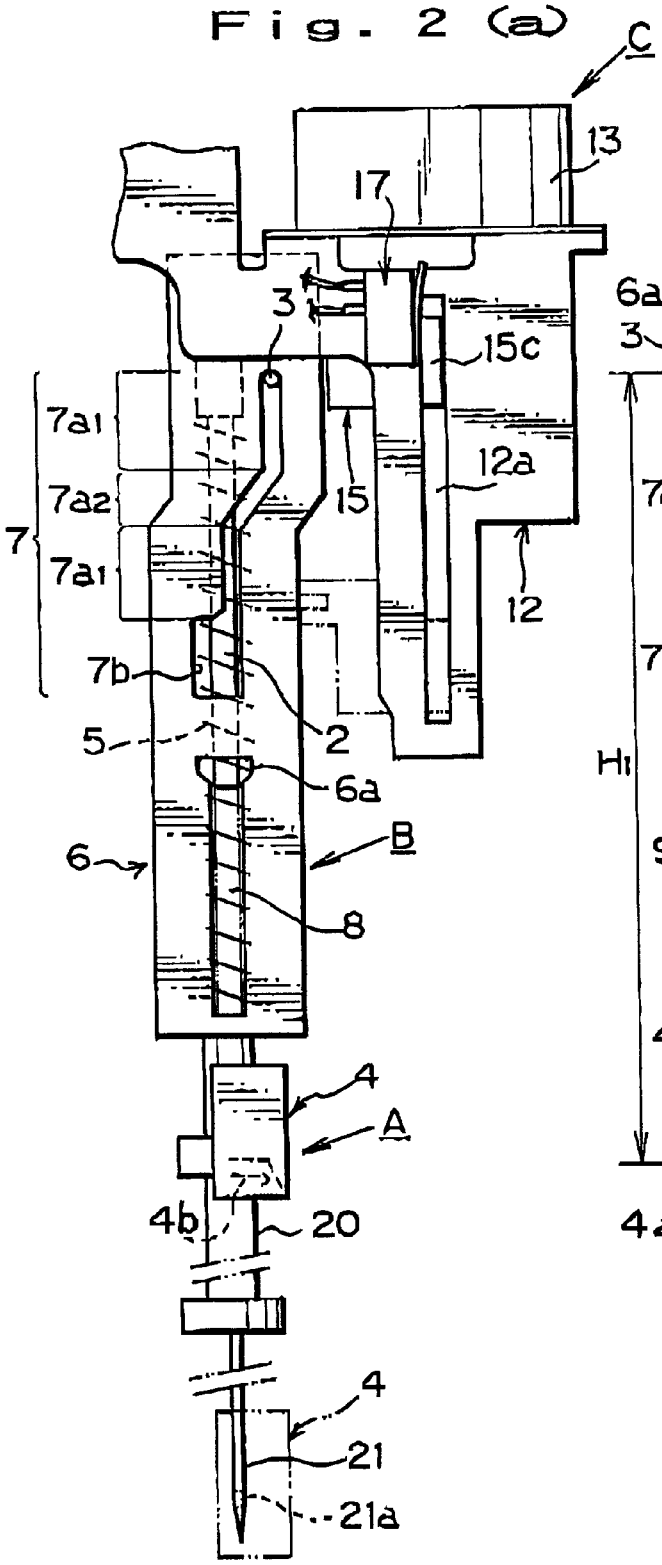
Figure 2:
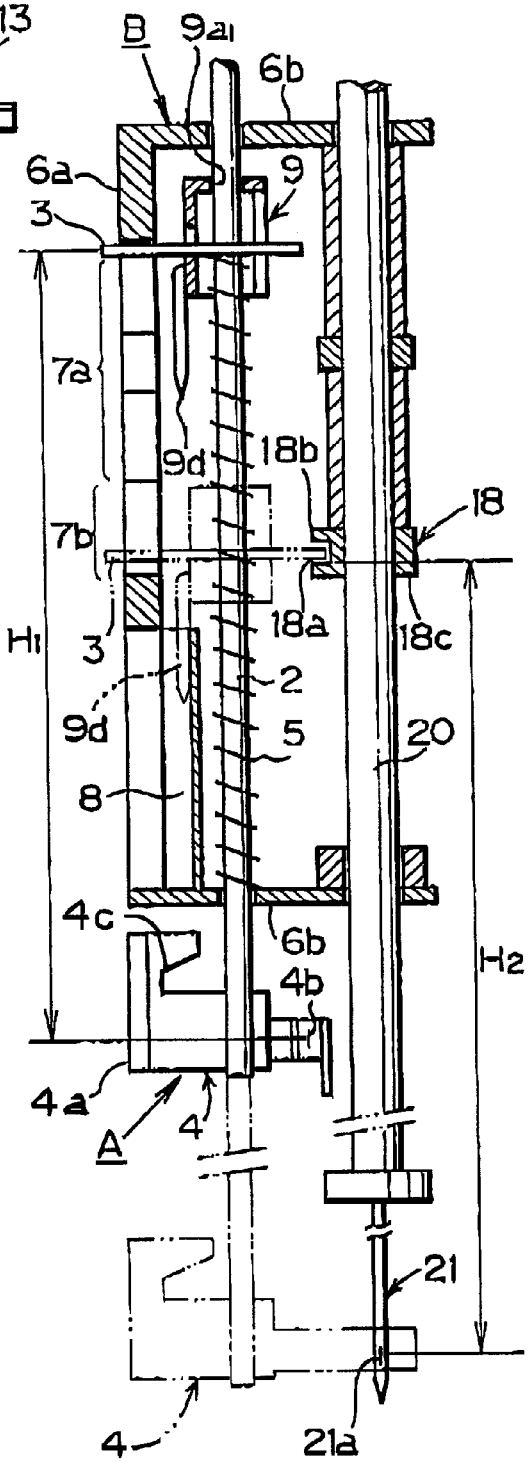
Figure 5:
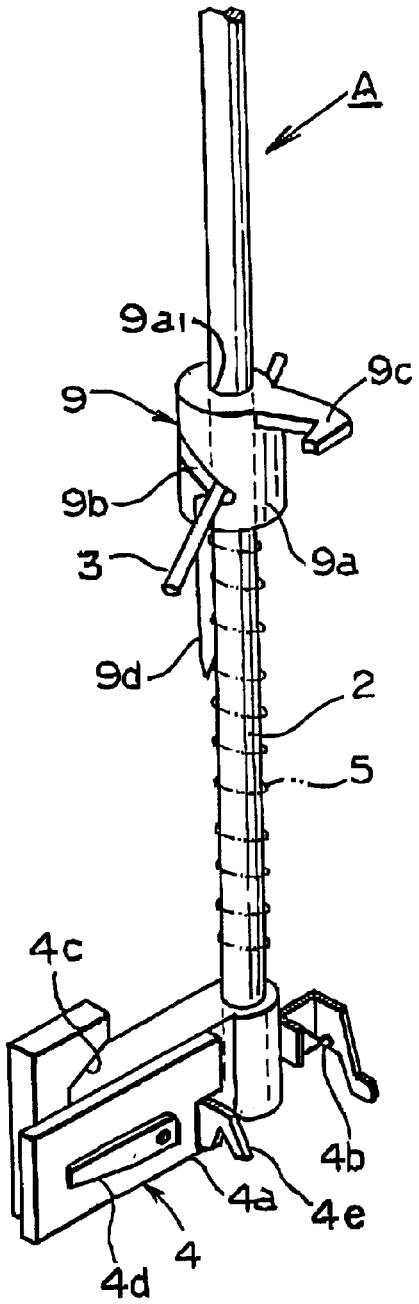
Figure 5:
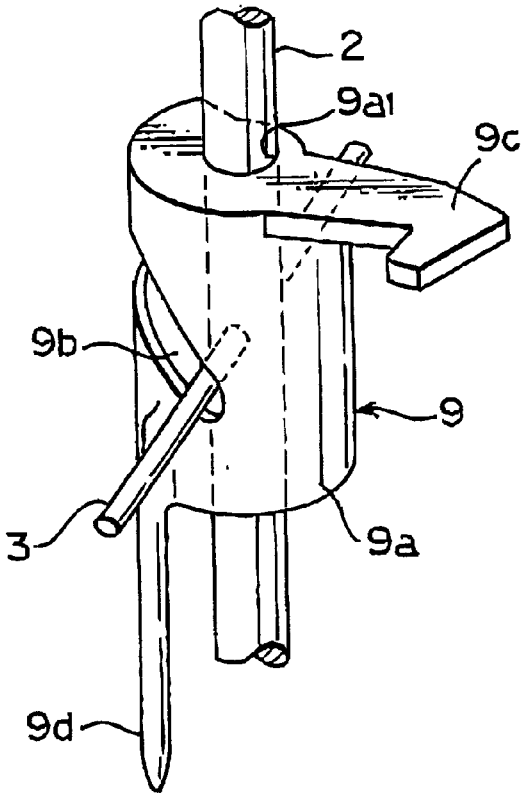
Figure 5:
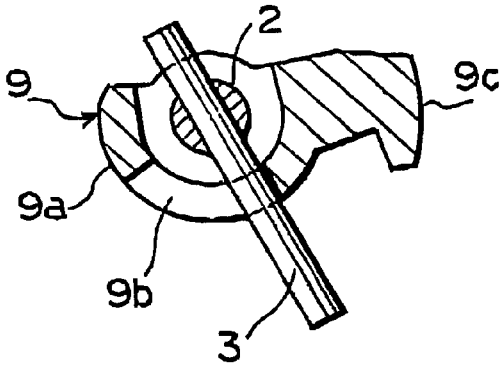

The guide pin 3 is inserted through the threading shaft 2 transversely thereof and is fixed thereto and has the opposite ends protruded radially of the threading shaft 2 as shown in FIG. 2(*b*) and FIGS. 5(*a*), (*b*). The guide pin 3 is moved up and down by an up-down guide member 9 which is operatively connected to the up-down drive portion C, and thus the threading shaft 2 is vertically moved as will be described in detail hereinlater.

The threading member 4 includes a swingable member 4*a* carrying the threading hook 4*b*. The swingable member 4*a* is fixed to the lower end of he threading shaft 2 and is swingingly moved with rotation of the threading shaft 2 in the circmferential direction thereof. Thus the threading hook 4*b* carried by the swingable member 4*a* is inserted into the needle eye 21*a* to pass a thread through the needle eye 21*a*. The guide pin 3 and the swingable member 4*a* are arranged with a predetermined angled provided therebetween, and a thread cutter 4*c* is formed at the swingable member 4*a* with a predetermined distance provided from the threading hook 4*b*. The predetermined distance L (FIG. 16 ①) between the threading hook 4*b* and the thread cutter 4*c* is decided in consideration of the length of spare thread to remain after being passed and cut, such that the spare thread will not come out of the needle eye 21*a* at the time of the subsequent stitch formation. By the way, it is effective to form a thread holder 4*d* at the thread cutter 4*c* for holding the thread with a mild force on the side facing the needle eye 21*a*. It is further effective to provide a thread guide 4*e* as shown in FIG. 5(*a*).

As shown in FIG. 1 and FIGS. 2(*a*), (*b*) the support portion B includes a frame member 6 having a vertical side wall 6*a* formed with a guide groove 7 of cam type and having upper and lower horizontal walls 6*b*, 6*b* for supporting the threading haft 2. The guide pin 3 has one end engaging the guide groove 7 so that the guide pin 3 may be vertically moved along the guide groove 7 as is guided thereby.

The threading shaft 2 has a coil spring 5 provided therearound. The coil spring 5 has the upper end pressed apt the guide pin 3 and the lower end pressed against the lower horizontal wall 6*b* of the frame member 6 as shown in FIG. 2(*b*) so that the threading shaft 2 may be normally urged in the upper direction.

As shown in FIG. 2(*a*), the guide groove 7 includes an upper groove 7*a* for guiding the vertical movement of guide pin 3 and a lower groove 7*b* for guiding the rotary movement of guide pin 3, the upper and lower grooves 7*a*, 7*b* being continuous. The upper groove 7*a* further includes a vertical groove portion $7a_1$, for preventing the guide pin 3 from being rotated in the horizontal plane and an angularly inclined groove portion $7a_2$ for allowing the guide pin 3 to rotate in the horizontal plane, the both groove portions $7a_1$, $7a_2$ being continuous and the latter extending from the former as is slightly inclined.

The angularly inclined groove portion $7a_2$ for is provided to slightly rotate the guide pin 3, thereby to slightly rotate the threading shaft 2 and the threading member 4, so that the threading member 4 may move round a projection such as a needle bar holder which is located on the needle bar 20 near the path through which the threading member is vertically moved.

The lower groove 7*b* has a generally rectangular opening of a space for allowing the rotary movement of guide pin 3 in cooperation with a regulating member 18 as will be described in detail hereinlater.

As shown in FIGS. 5(*a*) through (*c*), the up-down guide member 9 is provided to vertically move the threading shaft 2 through the guide pin 3. The up-down guide member 9 is generally semicircular in horizontal section having a wall 9*a* forming an axially extending hole $9a_1$. The up-down guide member 9 has an inclined groove 9*b* formed at the wall 9*a* thereof for receiving a part of the guide pin 3 as is extended therethrough transversely of the guide member 9 and partly protruded out thereof as shown in FIG. 2(*b*). The guide member 9 is axially mounted to the thread shaft 2 as is movable axially thereof. The up-down guide member 9 further has a radial extension 9*c*. The guide pin 3 has the opposite end passing through the inclined groove 9*b*.

The projection 9*c* is operatively connected to a drive member 15 of the up-down drive portion C as will be described in detail hereinlater. Further, the projection 9*c* is partly in contact with the width end of the vertical wall 6*a* of the frame member 6 to regulate the rotation of the up-down guide member 9 in the circumferential direction thereof as shown in FIG. 9(*b*) and FIG. 10(*b*).

The guide member 9 has an axially extending part 9*d* formed at the lower end thereof and the frame member 6 has a vertical groove 8 formed at the vertical wall 6*a* thereof, the vertical groove 8 being formed at a position downwardly of the guide groove 7 as shown in FIGS. 2(*a*) and (*b*), so that the axial extending part 9*d* may be inserted into the vertical groove 8 when the guide member 9 is moved down to move the guide pin 3 to the lower end of the vertical groove portion $7a_1$ that is just before the rotation guide groove 7*b*. Under the circumstances, when the guide pin 3 comes in the range of the rotation guide groove 7*b*, the guide member 9 is prevented from rotation and is movable only in the vertical direction.

The up-down drive portion C substantially includes a frame 12, a drive motor 13, a threaded shaft 14 and the aforementioned drive member 15. The drive motor 13 is mounted on the frame 12 which is mounted to the support portion B as shown in FIG. 1(*a*) and FIGS. 6(*a*) and (*b*). Preferably the drive motor 13 is a stepping motor which may correctly control the angular positions of the threaded shaft 14.

Figure 6:
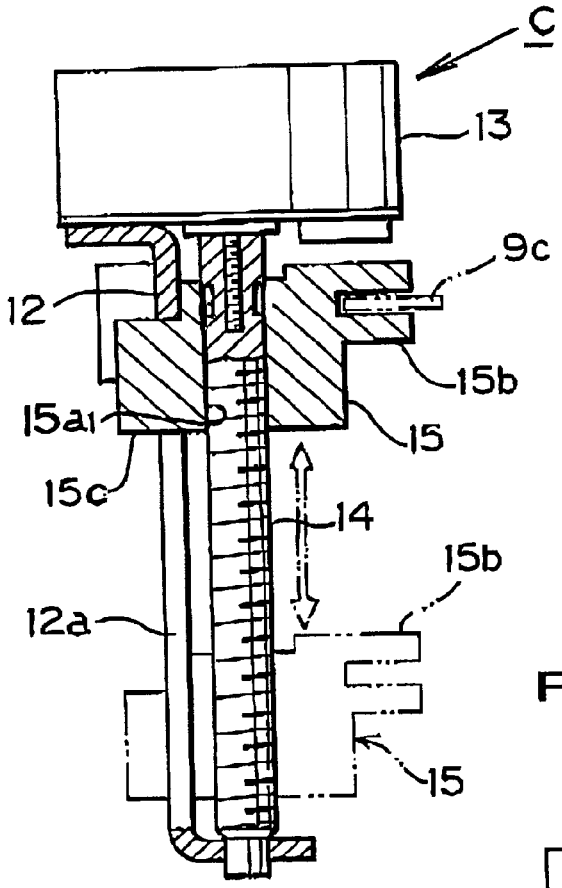
Figure 6:
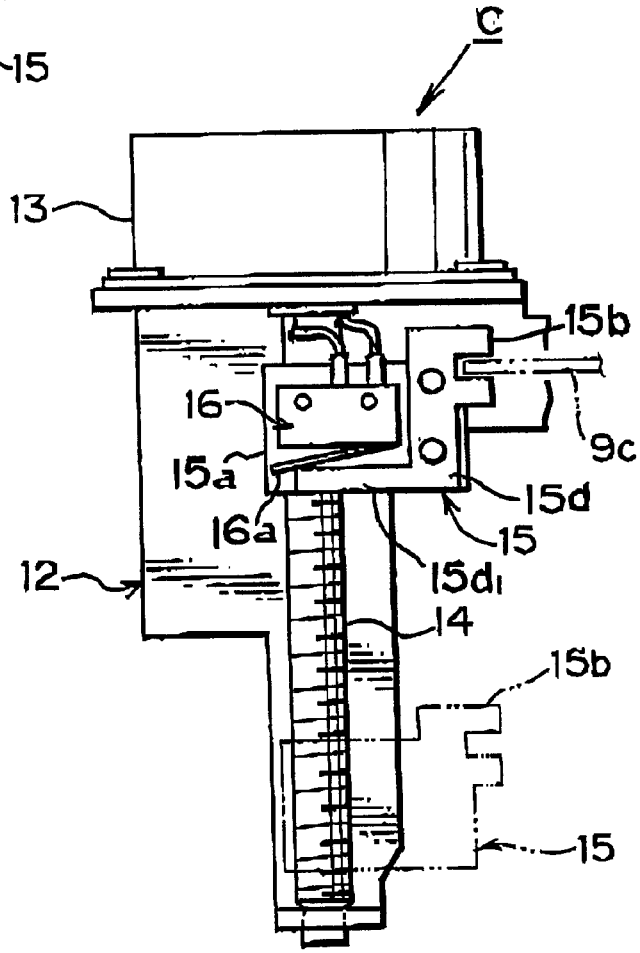

The drive motor 13 is directly connected to the threaded shaft 14 to rotate the same. The threaded shaft 14 is in threaded engagement with the axially threaded hole $15a_1$ of the base 15*a* of the drive member 15. Thus the threaded shaft 14 is rotated to move the drive member 15 axially thereof as shown in FIGS. 6(*a*) and (*b*). The drive member is operatively connected to the guide member 9 to vertically move the same.

The drive member 15 is provided with a radially extending recessed arm 15*b* which is in engagement with the projection 9*c* of the guide member 9 as receiving the same, wherein the projection 9*a* may be moved in the horizontal plane as shown in FIG. 4.

The frame 12 has a vertical guide groove 12*a* formed thereat which is in engagement with a radial projection 15*c* of the drive member 15 so that the drive member 15 may be vertically moved in a stabilized condition as is guided by the guide groove 12*a*.

A sensor is provided for detecting a lower stop position of the threading member 4 and another pressure sensor for detecting the trouble of the threading member 4. Precisely, the drive member 15 is provided with a pressure sensor 16 which detects the lower region of the threading member 4 and the subsequent rotation of the drive motor 13 which is required to rotate the threading hook 4*b* for threading in the rotary region. Further, the pressure sensor is provided to stop the drive motor 13 in case the threading member 4 is involved with the troubles including excessive load applied thereto wherein something foreign is attached or stuck to the threading member 4, thereby to prevent the damage of the threading member 4 and/or the needle 21.

Figure 7:
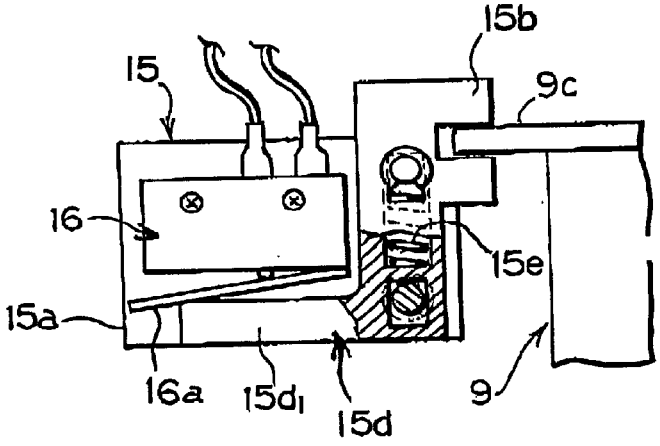
Figure 7:
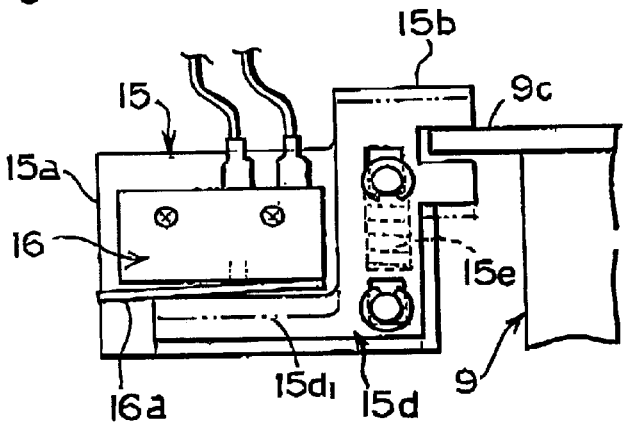

More precisely, as shown in FIG. 6(*b*), FIGS. 7(*a*) and (*b*), the pressure sensor 16 having an actuator 16*a* and a movable member 15*d* having an extension $15d_1$ are mounted to the base 15*a* of the drive member 15 so as to be moved together with the drive member 15. The movable member 15*d* is connected to the drive member 15 and is normally pressed down a coil spring 15*e* so that the movable member 15*d* may be moved up and down relative to the actuator 16*a* of the pressure sensor 16 in association with the up and down movement of the drive member 15, thereby to make the pressure sensor 16 on or off.

With this structure, the drive member 15 is moved down with rotation of the threaded shaft 14 and the guide member 9 is moved down in association with the movement of the drive member 15. In case some external force is exerted to the threading member 4 to forcibly stop the same, the movable member 15*d* is moved up against the action of the coil spring 15*e* to activate the actuator 16*a*, because the movable member 15*d* is operatively connected to the guide member 9 through the radially extending recessed arm 15*b* of the drive member 15 and the radial extension 9*c* of the guide member. Then the pressure sensor 16 detects that the threading member 4 has passed the descending region, and in the subsequent rotation region, reduces the rotation speed of the drive motor 13 so as to operate the threading hook 4*b* relative to the needle 21 without interference with the needle 21.

As shown in FIGS. 1(*a*) and (*b*), the needle bar 20 is supported by a support frame 22 which is fixedly connected to a sewing machine frame (not shown) The needle bat 20 is slidingly movable in the vertical direction relative to the support frame 22. The needle 21 having the needle eye 21*a* is removably attached to the lower end of the needle bar 20. The needle bar 20 is provided with a regulating member 18. The regulating member 18 is in a form of elongated hollow shaft and is in axially fixed engagement with the needle bar 20.

Figure 11:
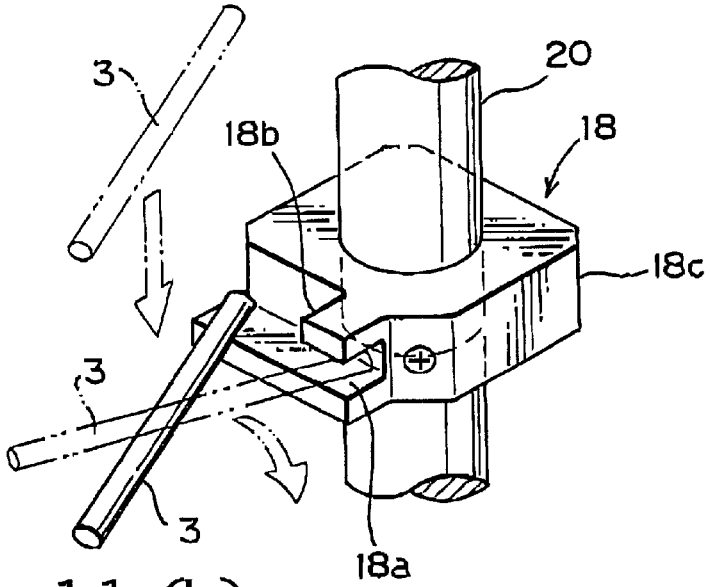
Figure 11:
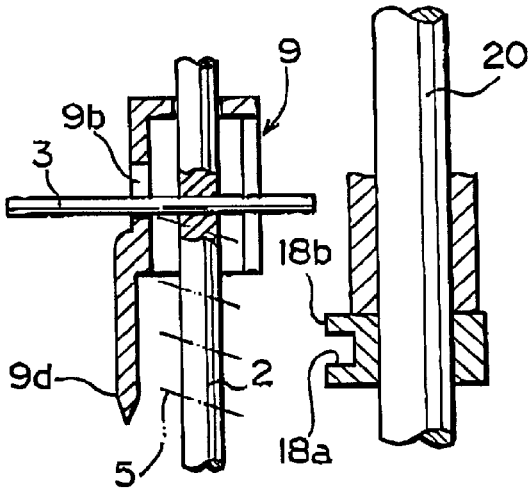
Figure 11:
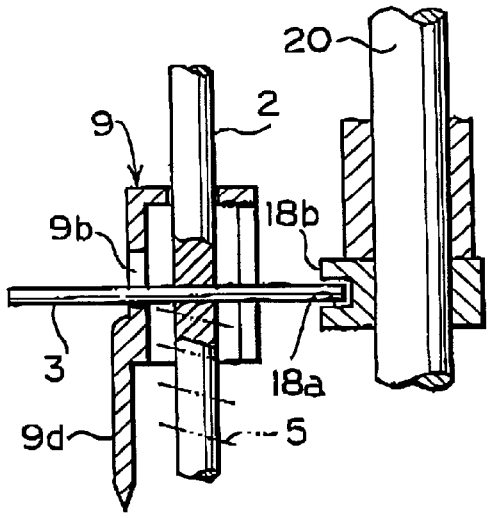
Figure 11:
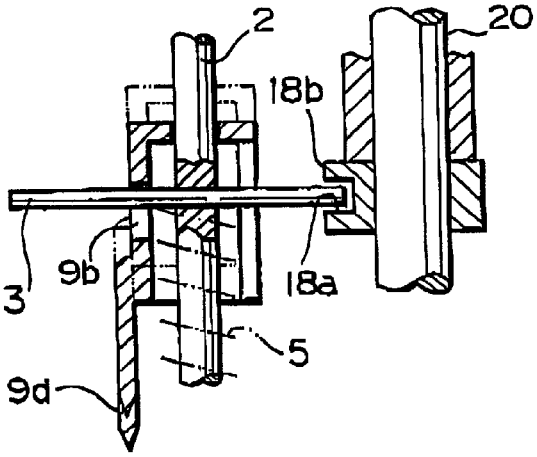

The regulating member 18 is formed with a laterally extending forked portion having upper and lower extensions 18*a*, 18*b*, the upper extension 18*b* having a regulating surface and the lower extension having a slide surface which may engage the inner end of the guide pin 13 and allows the rotation of the guide pin 13 in horizontal plane so that the threading hook 4*b* of the threading member 4 may be rotated through the threading shaft 2 to pass a thread through the needle eye 21*a* as shown in FIG. 2(*b*). The upper extension 18*b* is located at the position that is one end of the region where the guide pin 3 may slide as shown in FIG. 11(*a*). With the guide pin 3 being held between the upper and lower extensions 18*a*, 18*b* of the regulating member 18 as shown in FIGS. 11(*c*) and (*d*), the descending movement of the threading shaft 2 and the threading member 4 may be stopped by the regulating member 18. Further, in case a power failure is happened while the guide pin 3 is being rotated, the threading shaft 2 may be prevented from being moved up by the action of he coil spring 5.

Here, as shown in FIG. 2(*b*), it is required that the distance $H_1$ between the guide pin 13 of he threading shaft 2 and the threading hook 4*b* of the threading member 4 provided and the distance $H_2$ between the slide surface 18*a* of the regulating member 18 and the needle eye 21*a* of the needle 21 are identical, that is, $H_1=H_2$. Therefore, the position of the regulating member may be adjusted to satisfy the requirement as to the distance.

Figure 14:
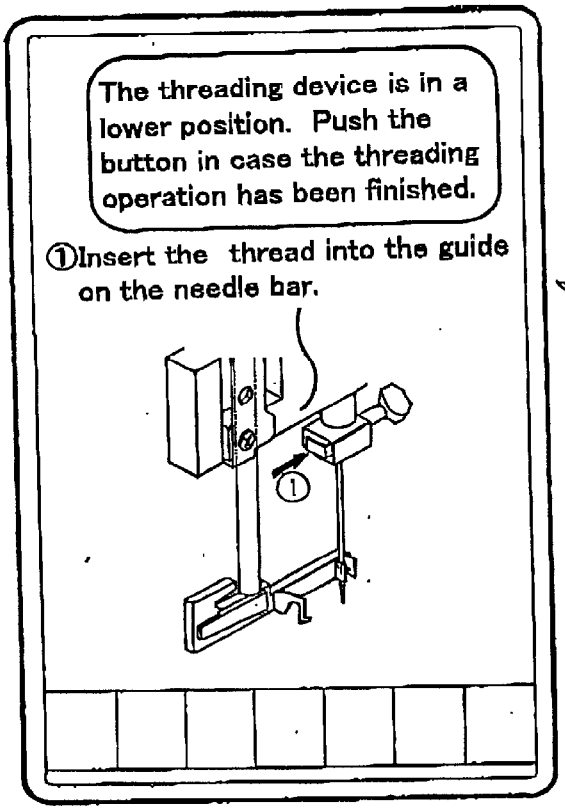
Figure 14:
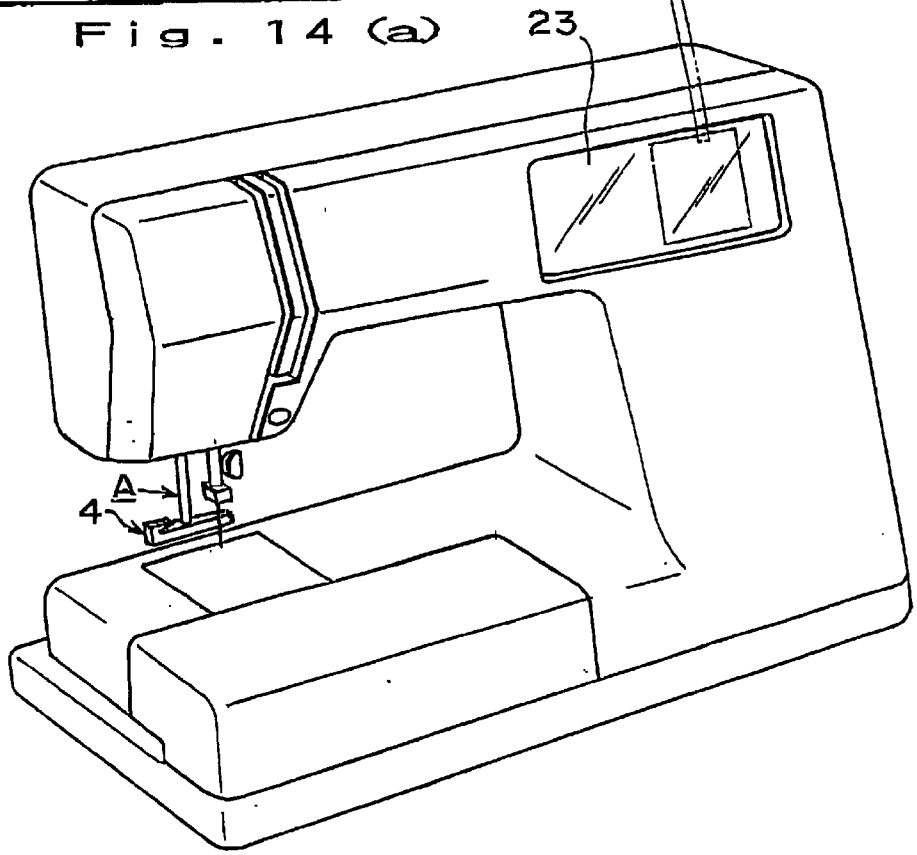

As shown in FIGS. 14(*a*) and (*b*), a display 23 is provided at the sewing machine. The display 23 is operated by operation of a threading switch to indicate the threading instructions which are stationary or movable as shown in FIGS. 15 ①, ②, ③, ④ and FIGS. 16 ⑤, ⑥, ⑦, ⑧. The display 23 further indicates a prohibition of threading operation during stitching operation and vice versa.

Figure 17:
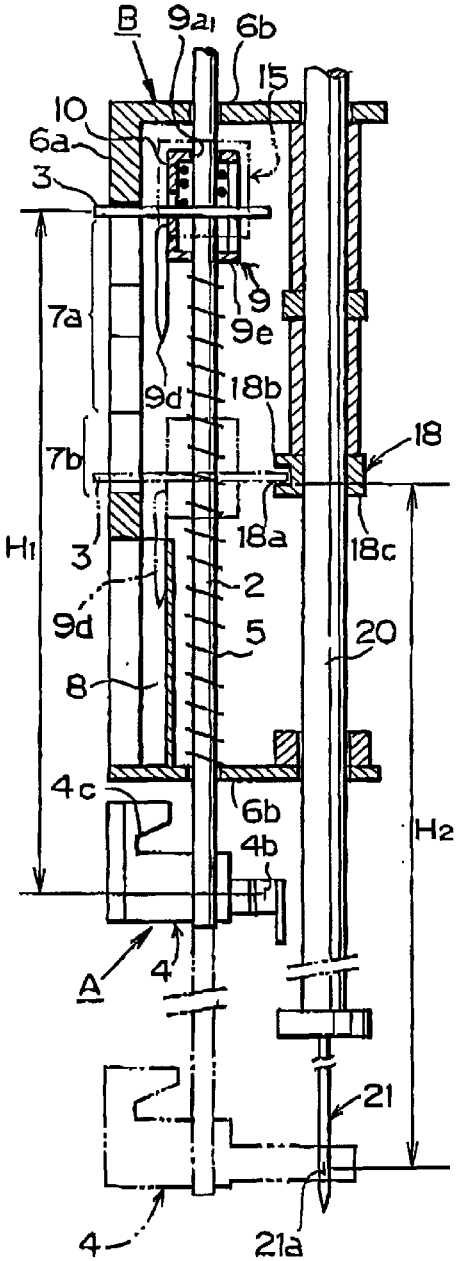
Figure 17:
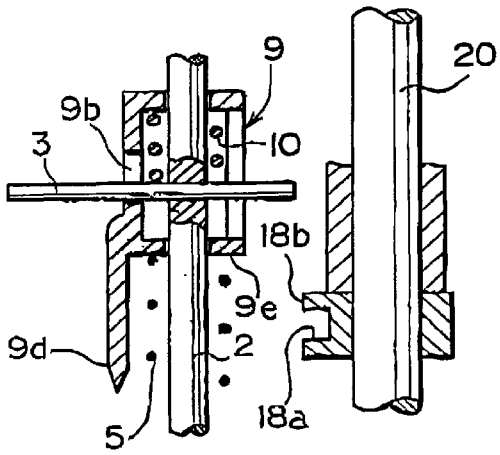
Figure 17:
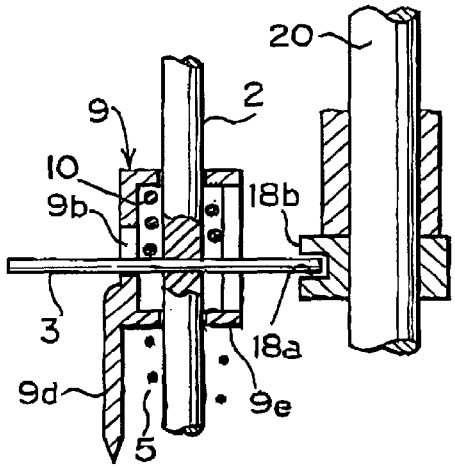
Figure 17:
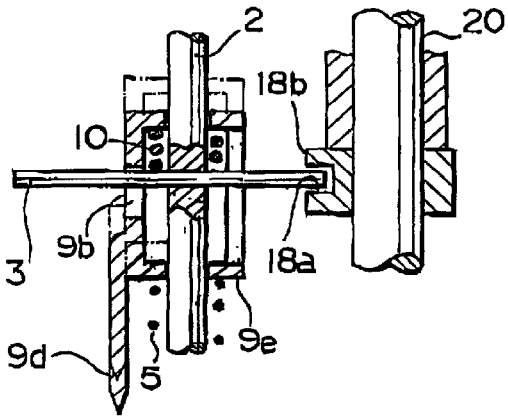
Figure 1:
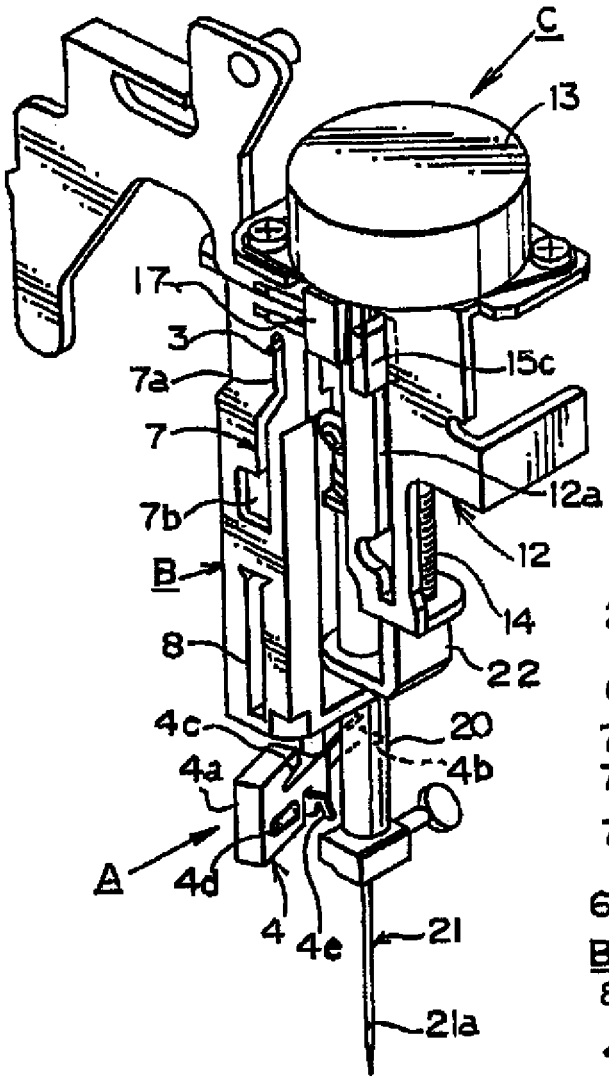
Figure 1:
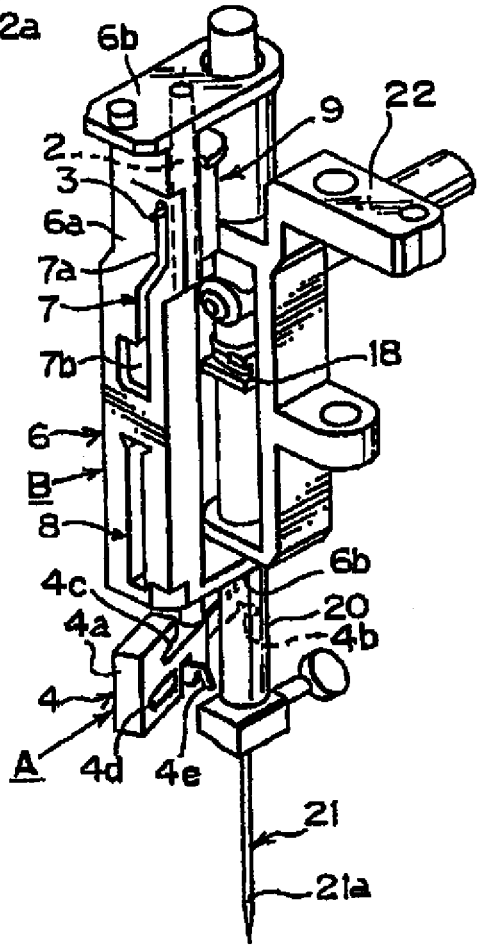
Figure 2:
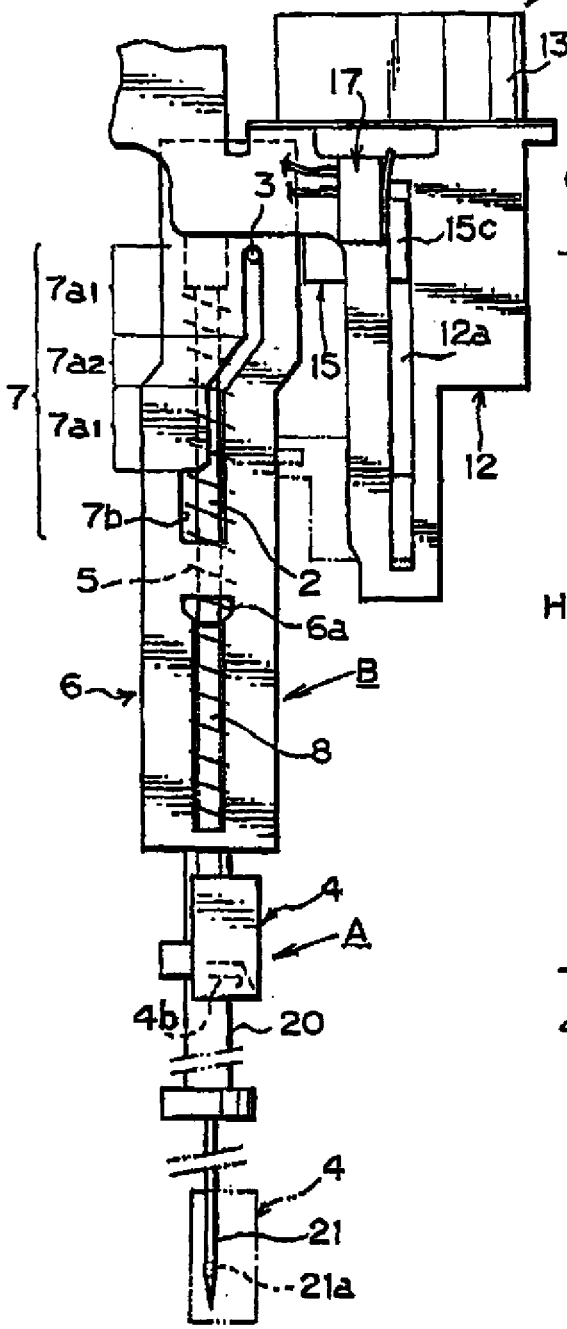
Figure 2:
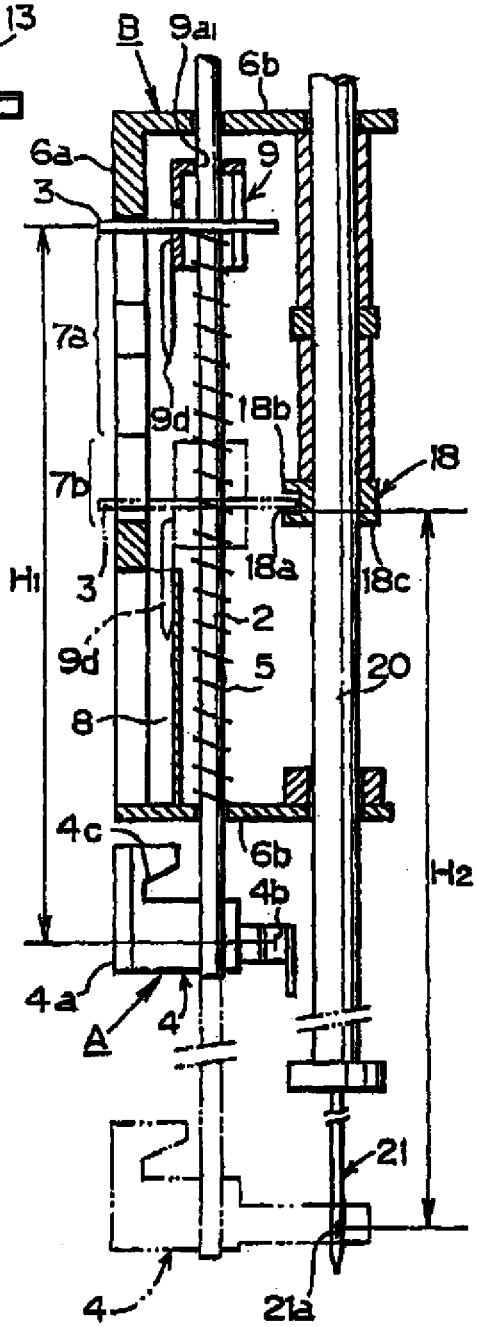
Figure 3:
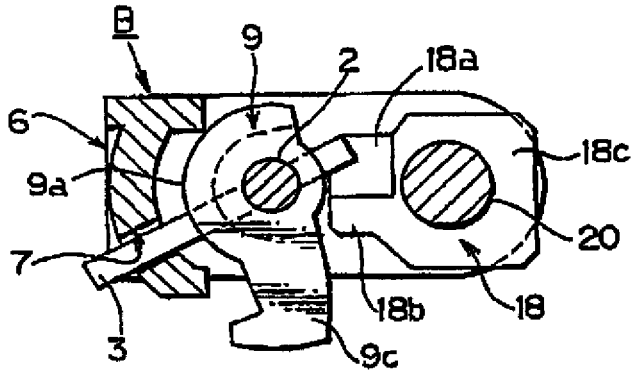
Figure 4:
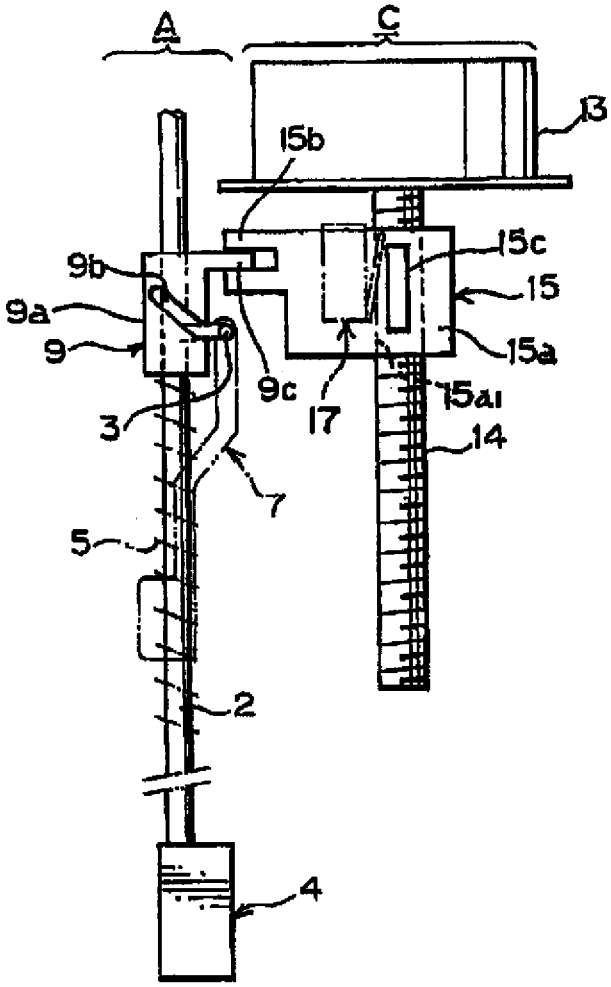
Figure 5:
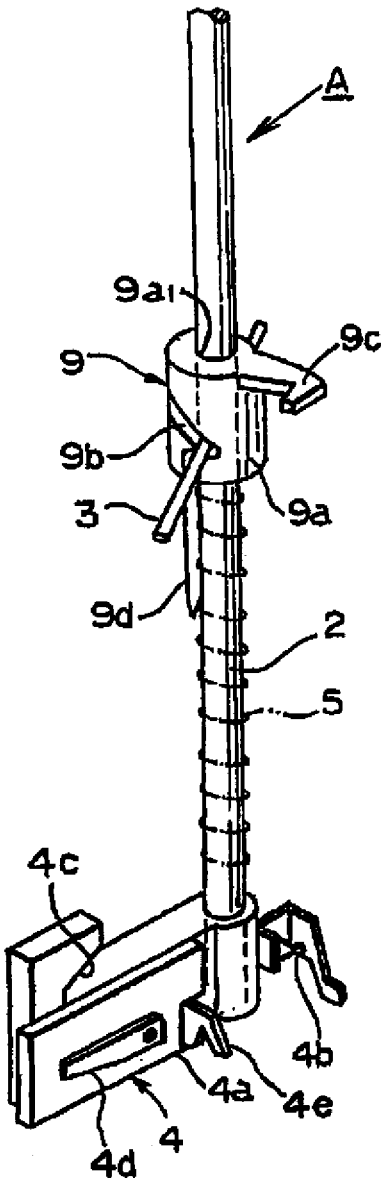
Figure 5:
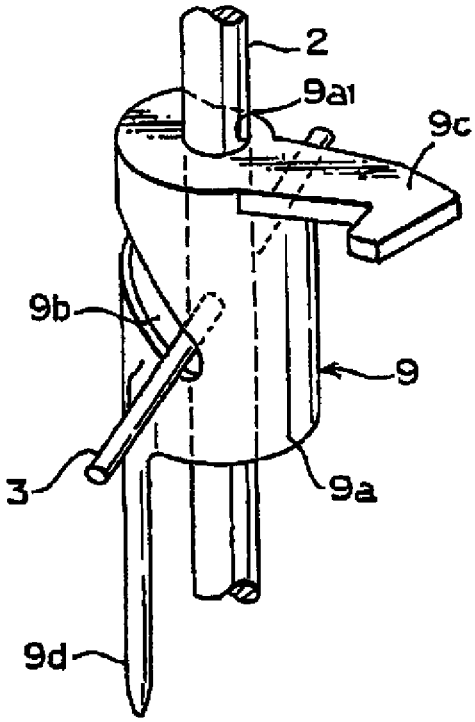
Figure 5:
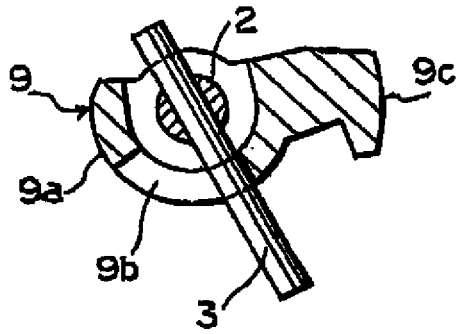
Figure 6:
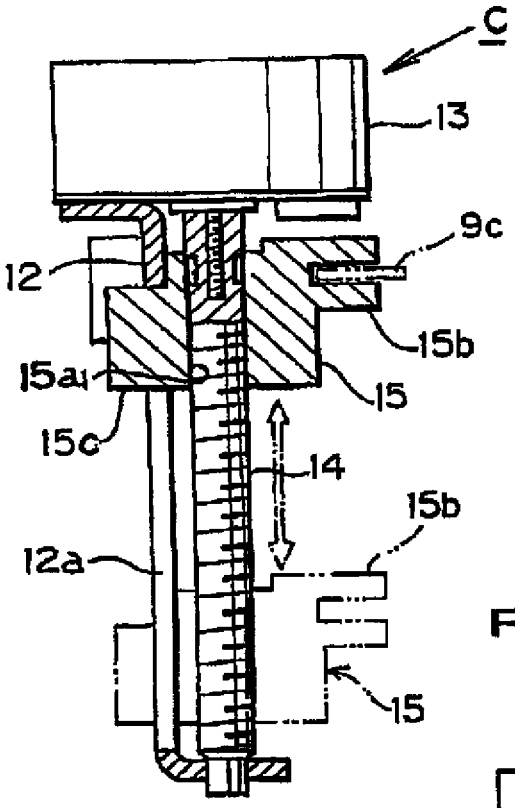
Figure 6:
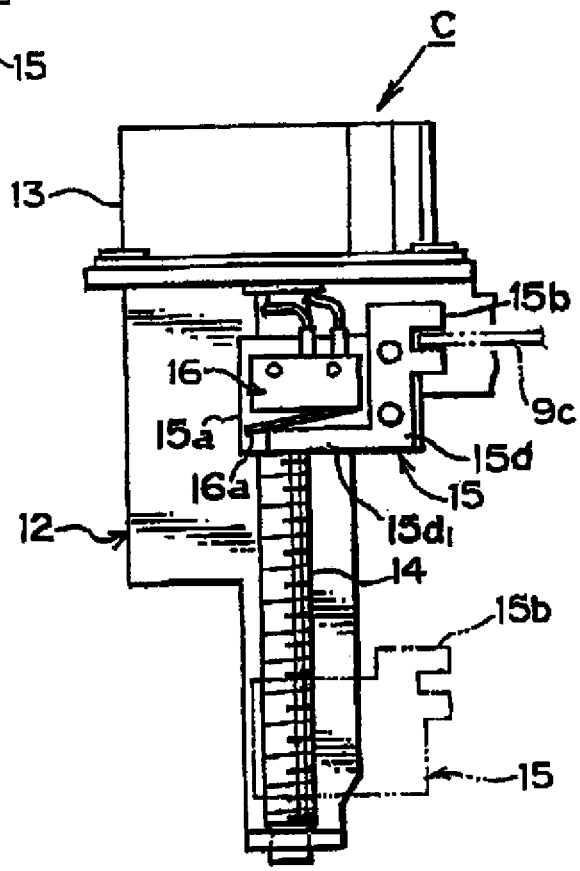
Figure 7:
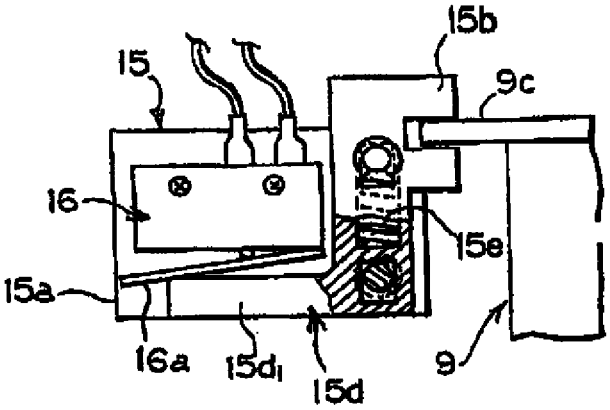
Figure 7:
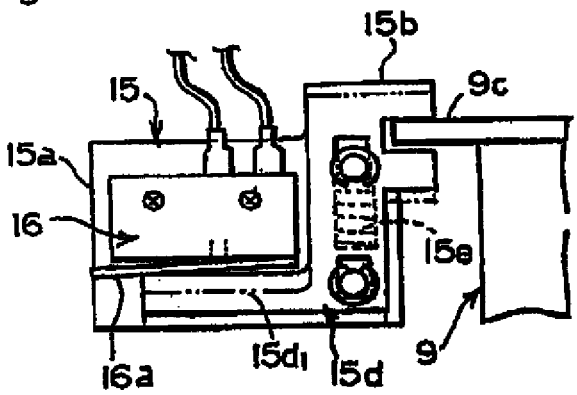
Figure 8:
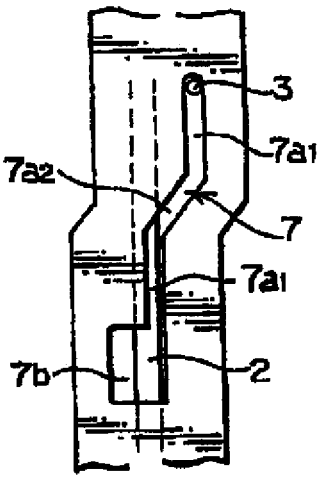
Figure 8:
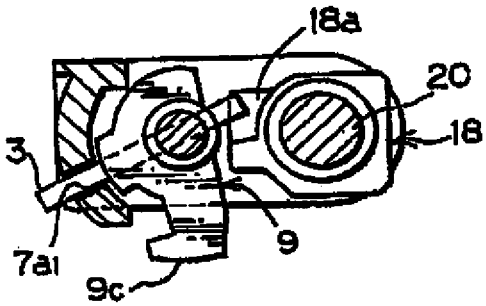
Figure 8:
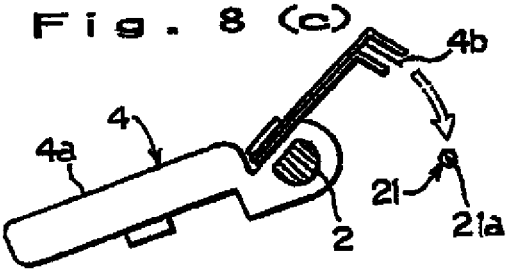
Figure 9:
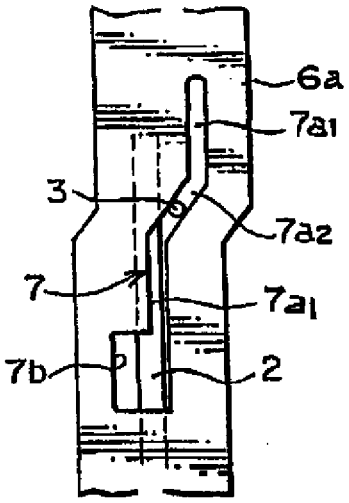
Figure 9:
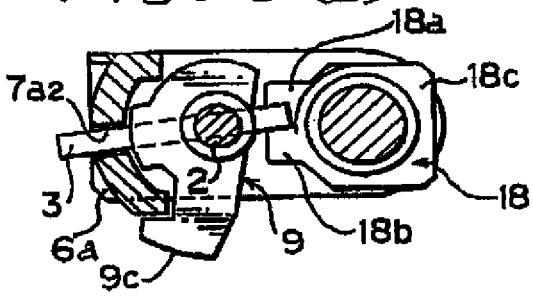
Figure 9:
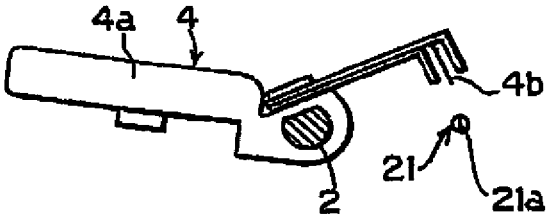
Figure 10:
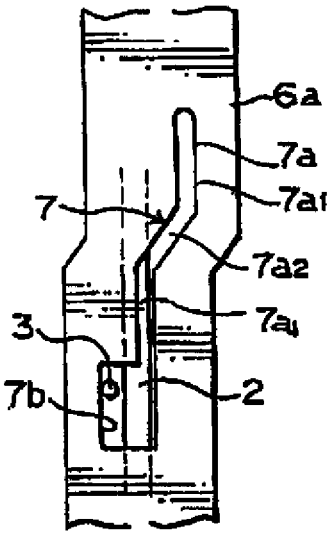
Figure 10:
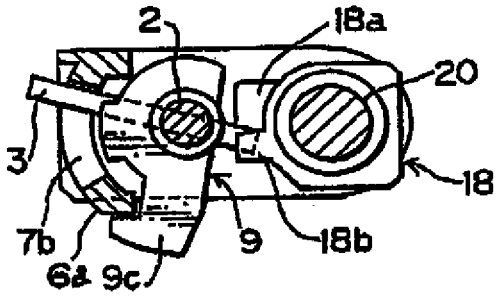
Figure 10:
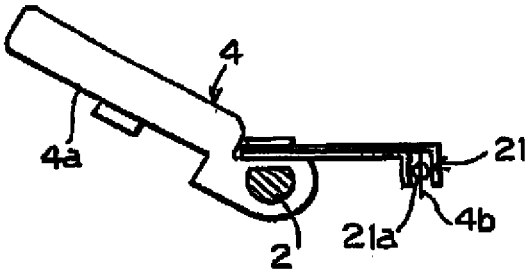
Figure 11:
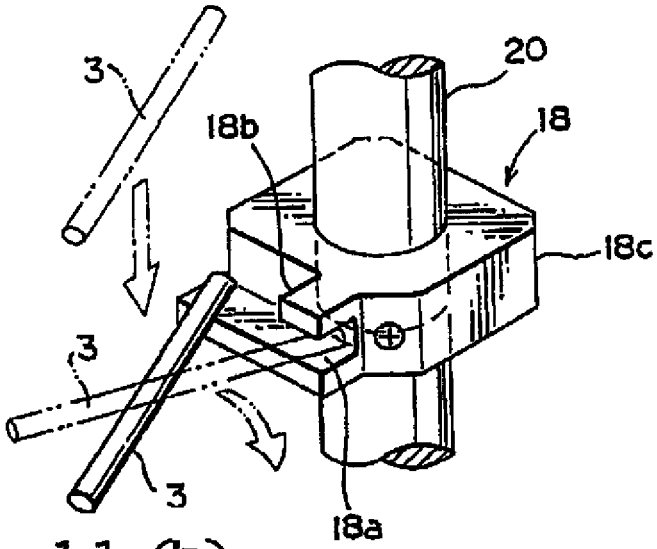
Figure 11:
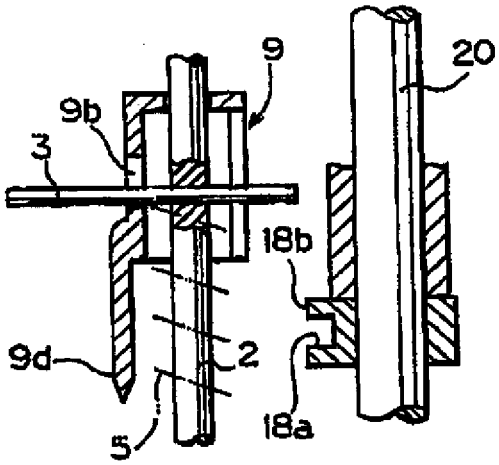
Figure 11:
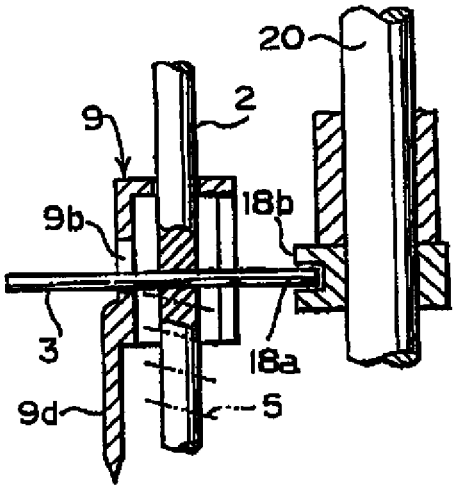
Figure 11:
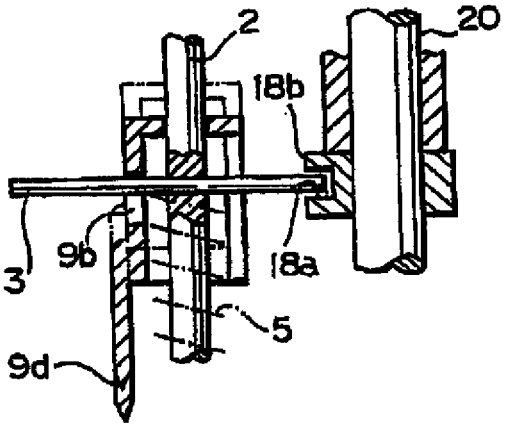
Figure 12:
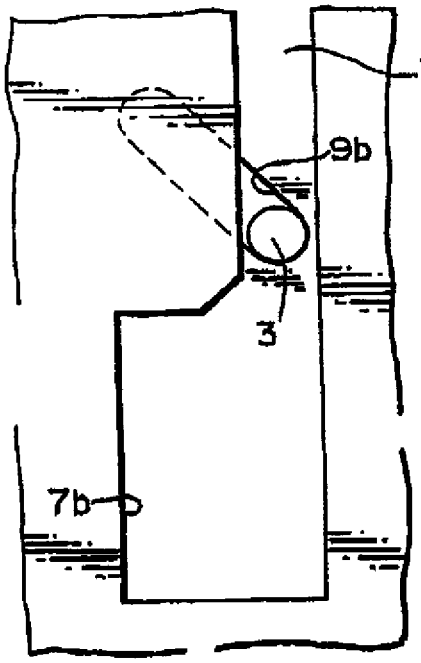
Figure 12:
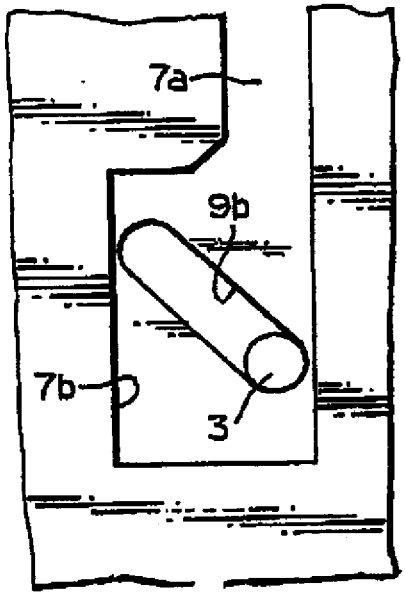
Figure 12:
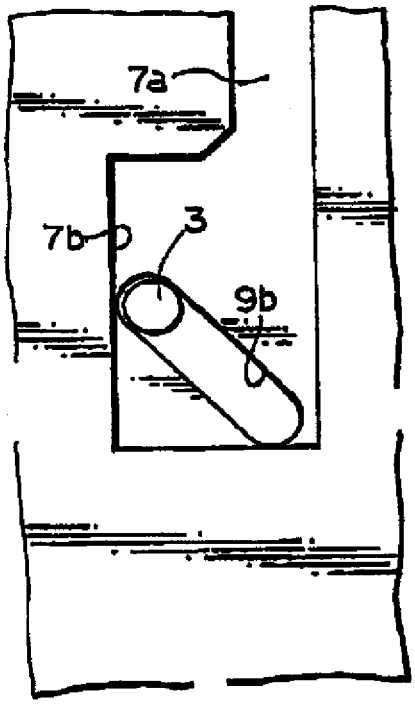
Figure 13:
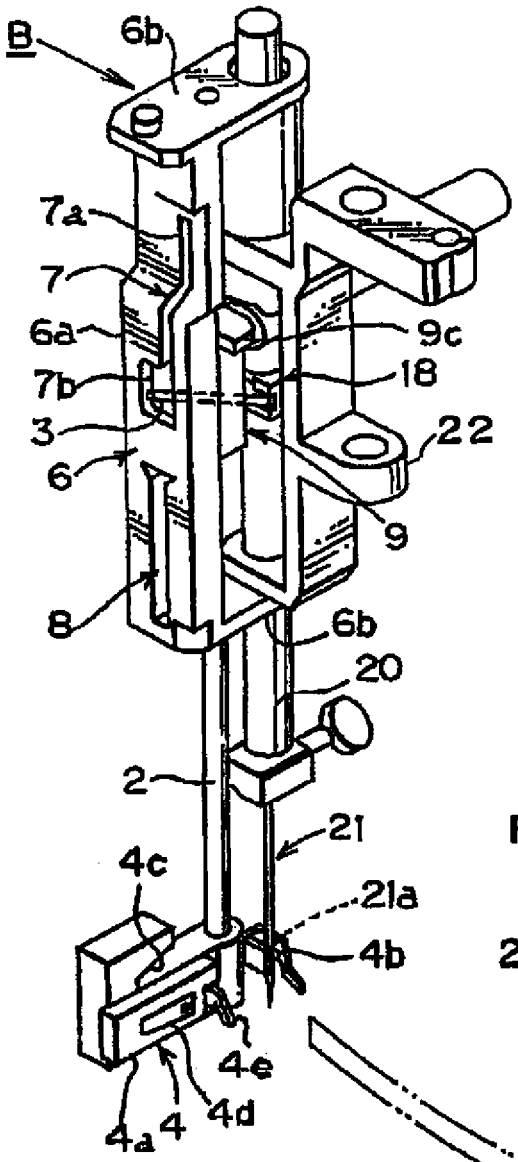
Figure 13:
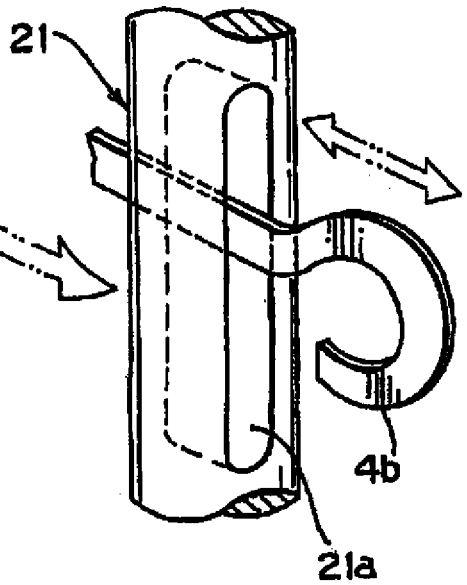
Figure 14:
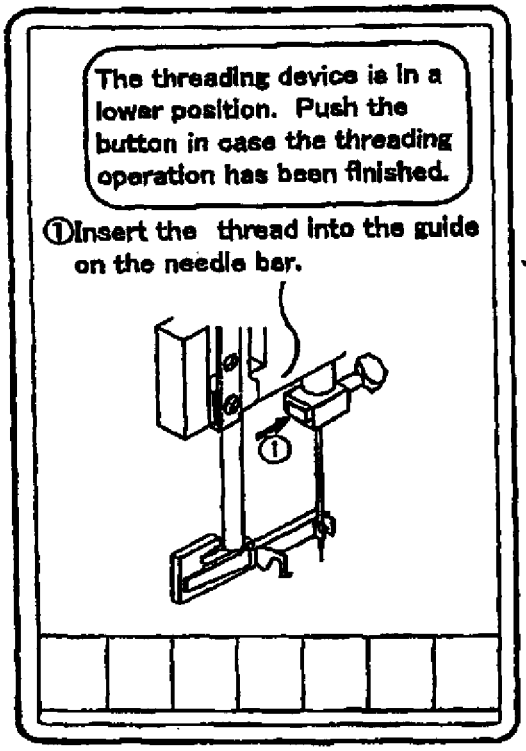
Figure 14:
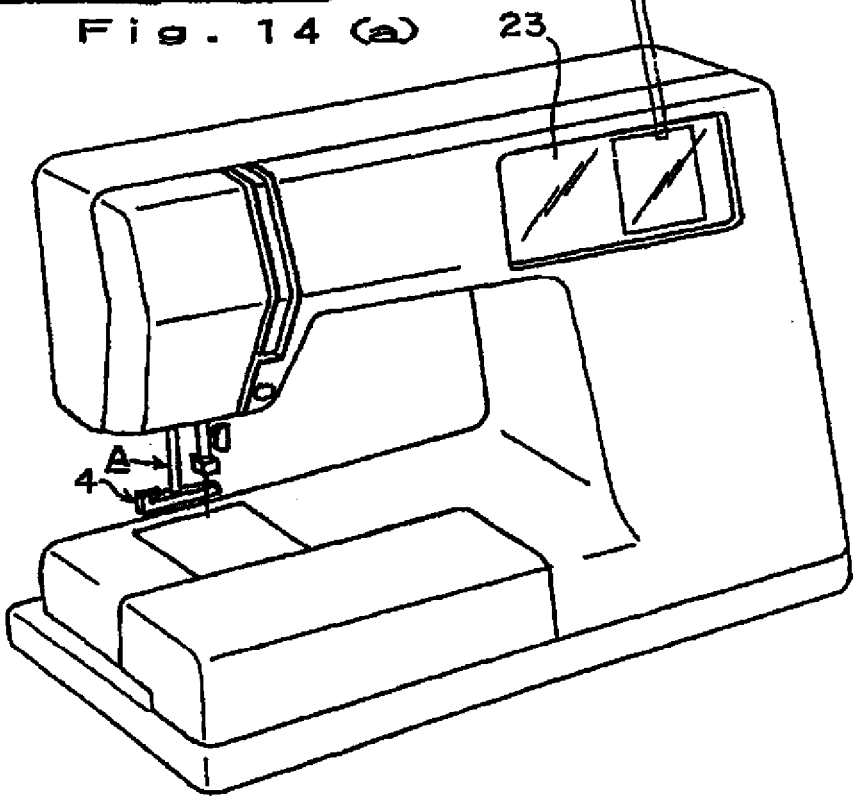
Figure 15:
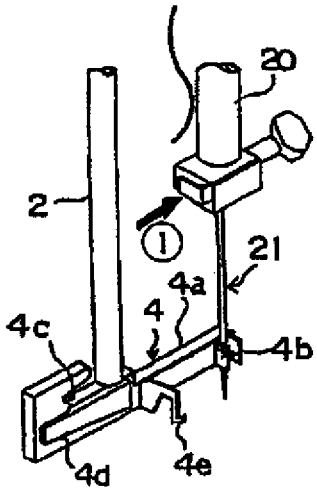
Figure 15:
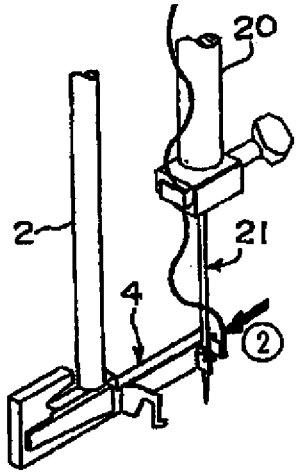
Figure 15:
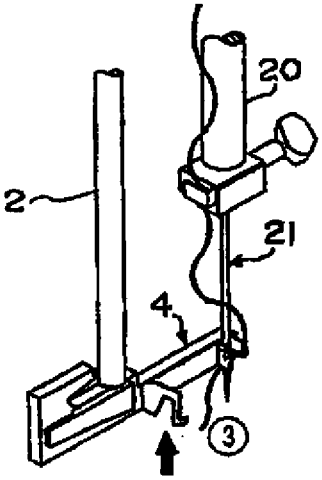
Figure 15:
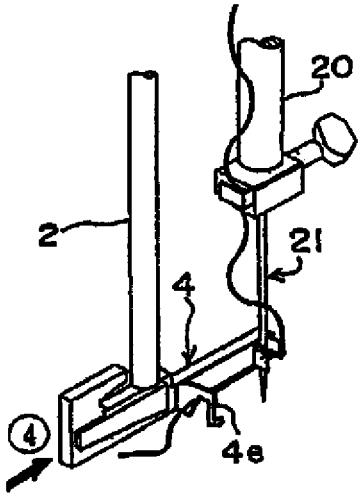
Figure 16:
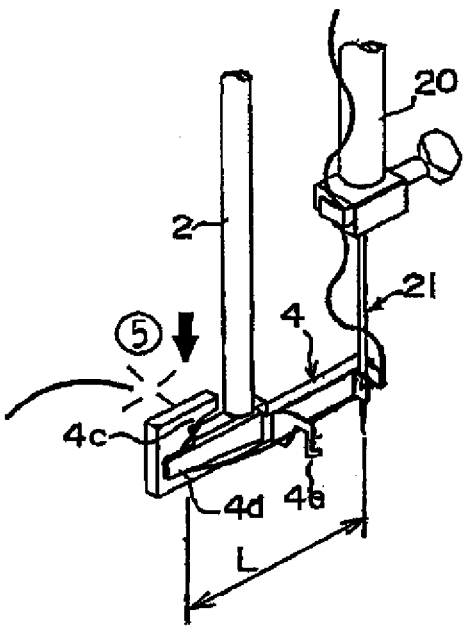
Figure 16:
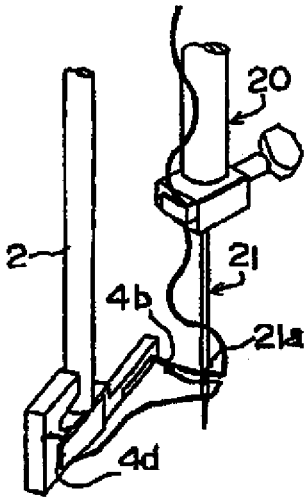
Figure 16:
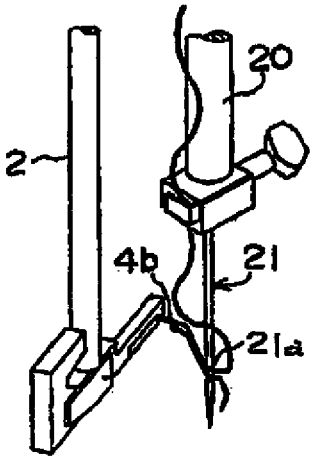
Figure 16:
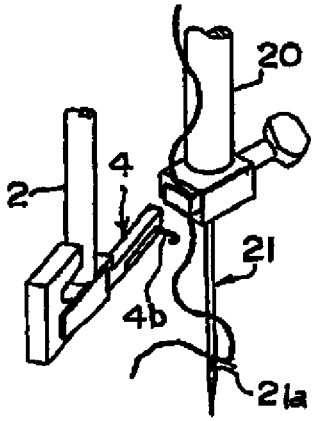
Figure 17:
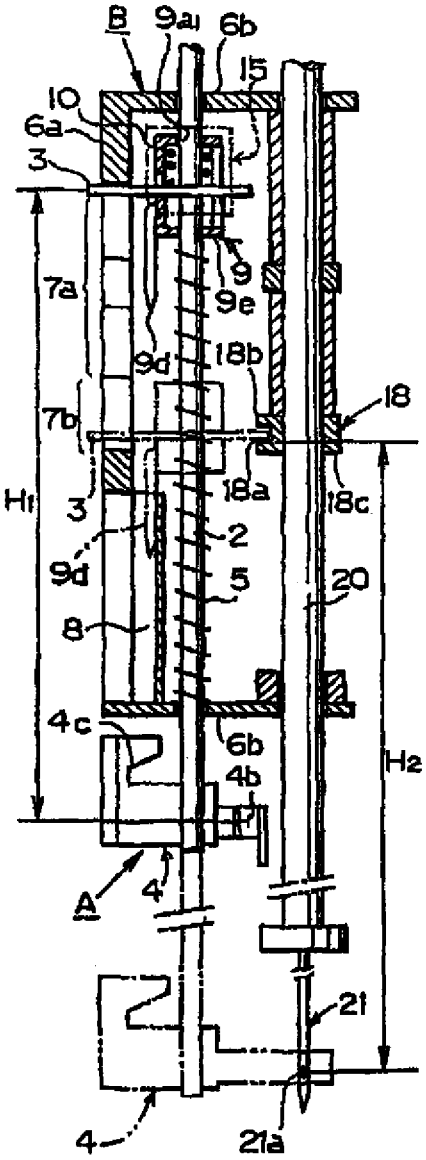
Figure 17:
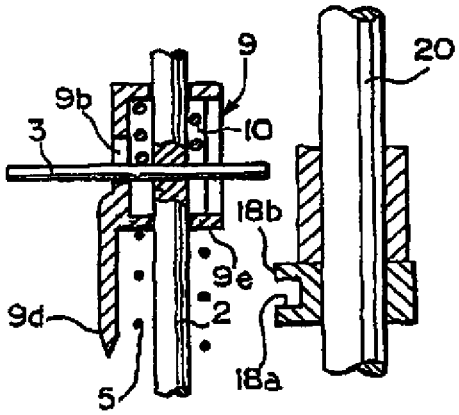
Figure 17:
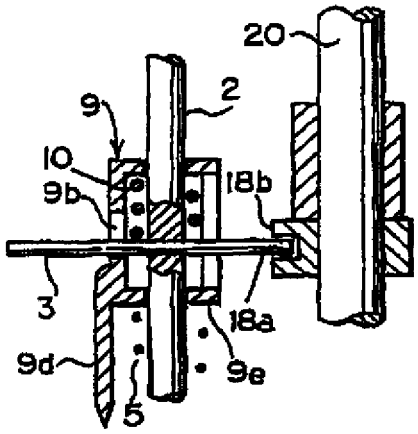
Figure 17:
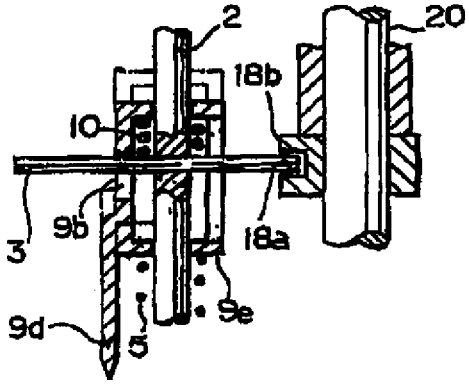

According to the invention, the guide pin 3 may be normally pressed down by a compression spring 10 provided between the guide member 9 and the guide pin 3 as shown in FIGS. 17(*a*), (*b*), the compression spring 10 being of a force stronger than the coil spring 5. In this case it is preferable that the upper end of coil spring 5 is pressed against the lower end 9*e* of the guide member 9.

The up-down guide member 9 may be moved down with descending movement of he drive member 15. As the inner end of the guide pin 3 comes to contact the slide surface 18*a* of the regulating member 18, the guide member is then moved down against the action of the compression spring 10 as is axially rotated along the inclined groove 9*b* thereof as shown in FIGS. 17(*c*), (*d*). Therefore, the threading shaft 2 is axially rotated accordingly to rotate the threading member 4. Thus the threading hook 4*b* is inserted into the needle eye 21*a* to pass a thread through the needle eye 21*a* with subsequent pullback of the threading hook 4*b*. In case the guide member 9 is moved up with ascending movement of the drive member 15, the compression spring 10 acts as to press down the guide pin 3 along the inclined groove 9*b* of the guide member 9. The guide pin 3 is, therefore, moved down along the inclined groove 9*b* instantly when the guide member 9 starts to ascend. As the result, the threading shaft 2 and accordingly the threading member 4 is axially rotated in the opposite direction, and the threading hook 4*b* is pulled out of the needle eye 21*a*. Thus the series of operations way be smoothly performed.

Operation is as follows:

Prior to threading operation, it is required that the needle bar 20 is an upper position. In the initial stage, the guide pin 3 is positioned at the upper end of the guide groove 7 as shown in FIG. 8(*a*). The drive motor 13 is driven by operation of a switch (not shown) to rotate the threaded shaft 14.

With rotation of the threaded shaft 14, the drive member 15 is moved down along the threaded shaft 14 as shown in FIG. 6. Simultaneously a limit switch 17 is operative to confirm the movement of the drive member 15. As the drive member 15 is moved down, the guide member 9 is move down through the connection arm 15*b* of the drive member 15.

The descending movement of the guide member 9 is transmitted to the threading shaft 2 through the guide pin 3. The guide pin 13 is moved down along the guide groove 7. As the guide pin 3 comes to the range of the angle changing groove $7a_2$ as shown in FIGS. 9(*a*) and (*b*), the threading shaft 2 starts axial rotation so that the threading member 4 may be moved down avoiding the needle holder for fixedly mounting the needle 21 to the lower end of the needle bar 20.

Figure 10:
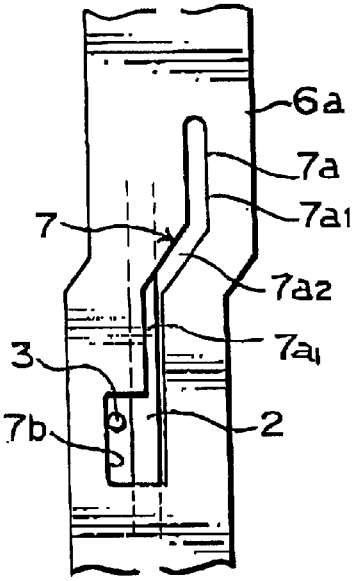
Figure 10:
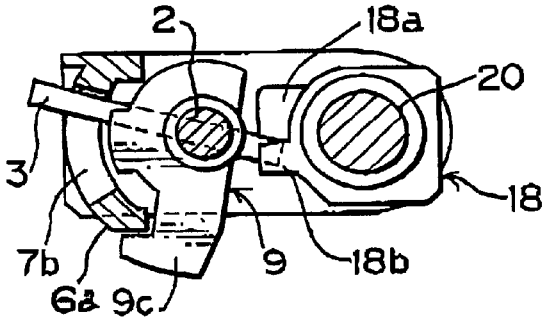
Figure 10:
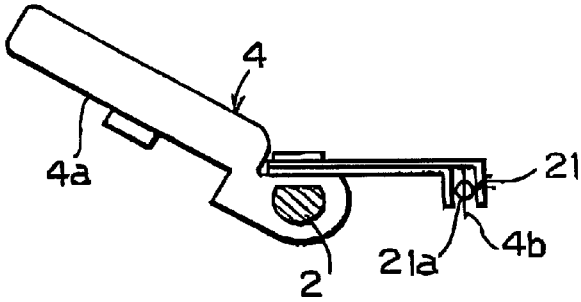
Figure 12:
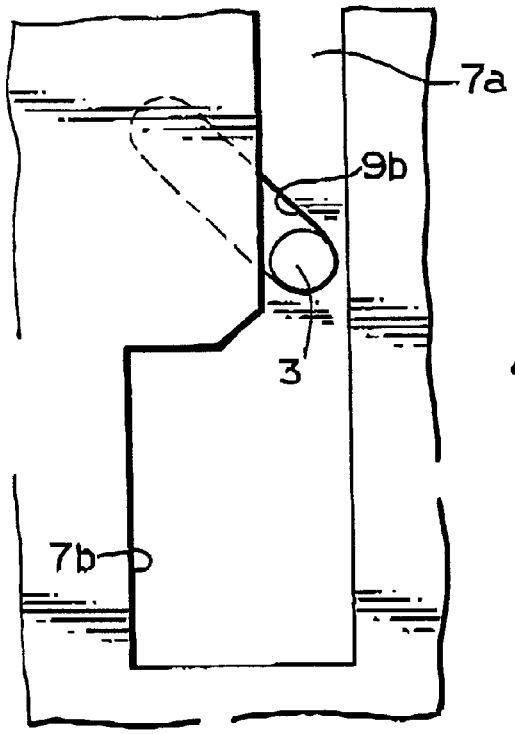
Figure 12:
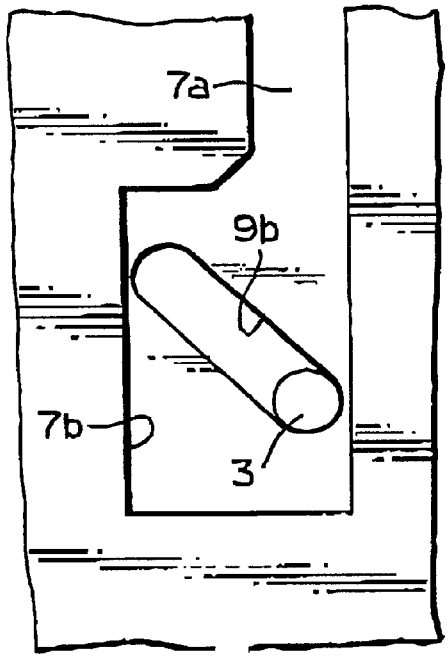
Figure 12:
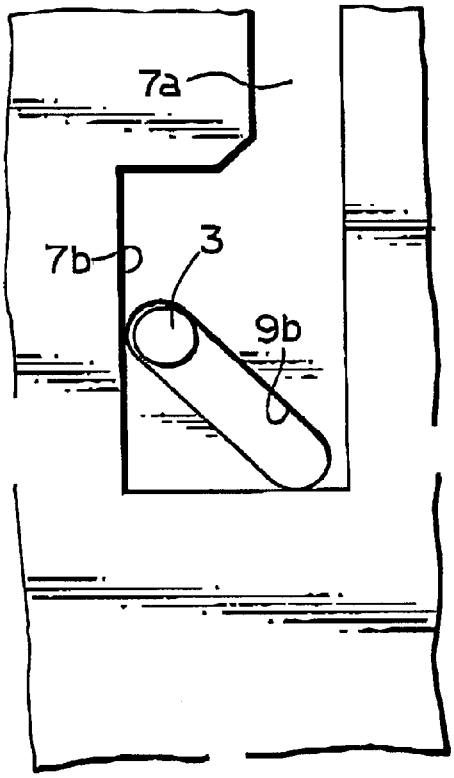

As the drive member 15 is further moved down, the guide pin 13 comes to the region of rotation guide groove 7*b*. In the region of vertical groove $7a_1$ just before the rotation guide groove 7*b*, the opposite end of he guide pin 3 comes to contact the slide surface 18*a* of the regulating member 18 to stop the movement of the threading shaft 2 and the threading member 4 accordingly as shown in FIGS. 10 through 12. In his case, the positions of the threading hook 4*b* and of the needle eye 21*a* are on the same level.

With the subsequent descending movement of the guide member 9, the threading shaft 2 is axially rotated as the guide pin 3 is rotated as is guided along the inclined groove 9*b* of the guide member 9. The load resistance at the time of rotation of the threading shaft 2 is higher than the one at the time of descending movement of the threading shaft 2 drive member 15. Namely the load resistance is higher than the reacting force of the coil spring 15*e* arranged at the drive member 15. Therefore, when the guide pin 3 comes to the rotation region from the descending region where the guide pin 3 contacts the regulating member 18, the drive member 15 is stopped as is moved against the action of the coil spring 5*e*.

Figure 13:
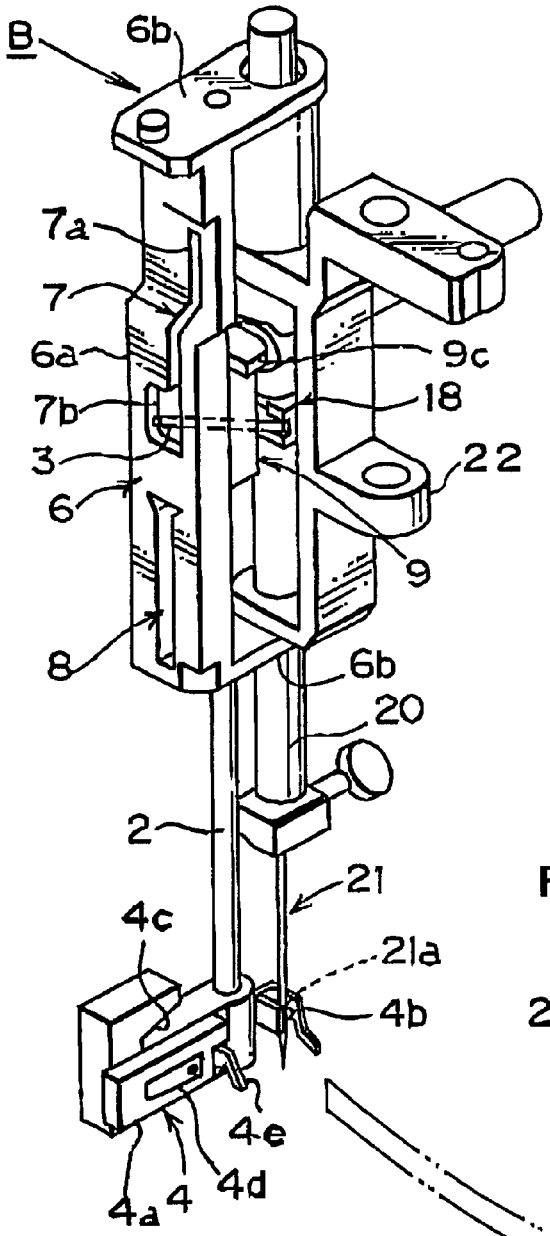
Figure 13:
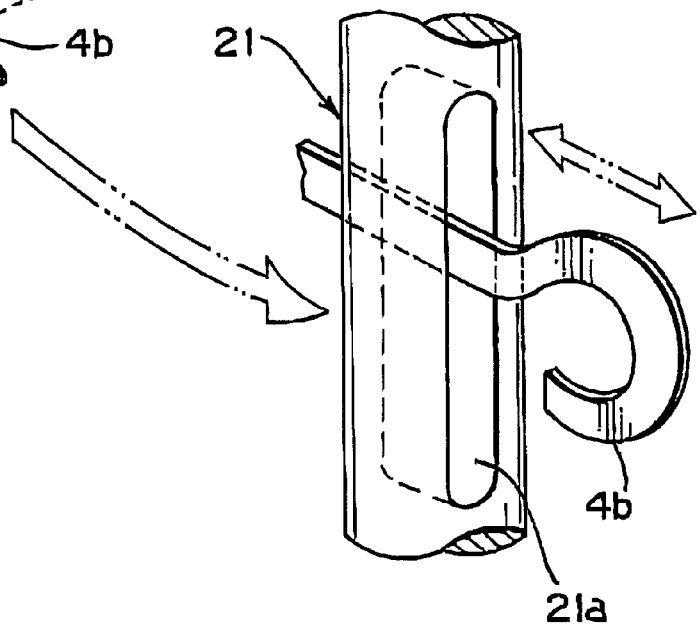

The movable member 15 is operated to move up the actuator 16*a* of the pressure sensor 16, thereby to activate the pressure sensor 16 to detect the descend end position. Subsequently the drive motor 13 is rotated to a certain amount as is required. Such predetermined rotation amount of the drive motor 13 will further move down the guide member 9 to rotate the guide pin 3 through the inclined groove 9*b*, thereby to axially rotate the threading shaft 2 and the threading hook 4*b* accordingly. Thus the threading hook 4*b* is inserted through the needle eye 21*a* of the needle 20 as shown in FIGS. 13(*a*) and (*b*). In this condition, the drive motor 13 is stopped with maintaining current being supplied until the subsequent ascend signal is given.

Subsequently, the thread extending from the thread supply (not shown) to be passed through the needle eye 21*a* is hung to the threading hook 21*a* as shown in FIGS. 15 ① through ④. The free end portion of the thread is then hung to the thread holding member 4*d* and is cut off by pressingly contacting the thread against the thread cutter 4*c* was shown in FIGS. 16 ⑤ and ⑥. The distance between the thread cutter 4*c* and the needle eye 21*a* is decided to correspond to the length of thread which is sufficient to be supplied to form the subsequent stitch without being pulled out of the needle eye 21*a*.

Figure 16:
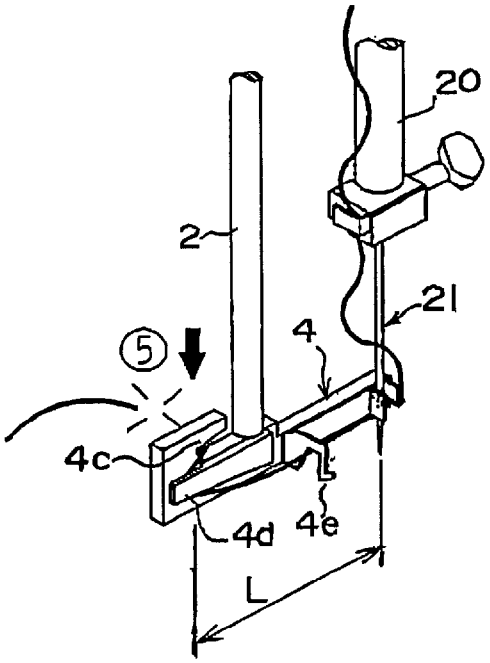
Figure 16:
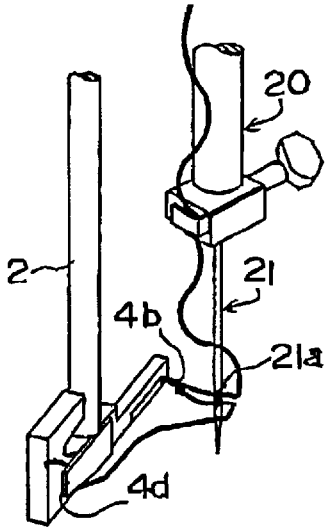
Figure 16:
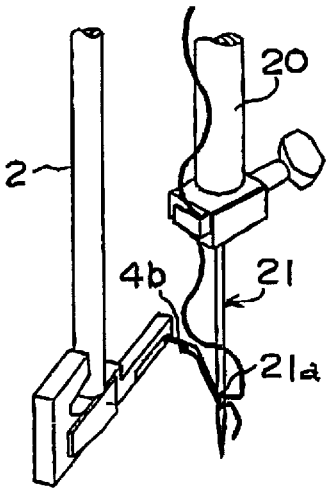
Figure 16:
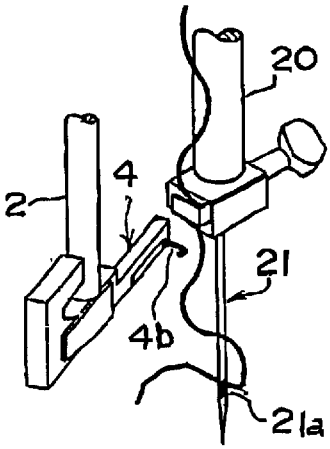

When the thread is cut off, a returning signal is produced to move up the threading member 4. Then the drive motor 13 is rotated in the opposite direction in response to the returning signal to axially rotate the threading shaft 2 while the guide pin 3 is moved along the inclined groove 9*b* of the guide member 9, thereby to pull the threading hook 4*b* out of the needle eye 21*a* as shown in FIGS. 16 ⑥ and ⑦.

Preferably the trending hook 4*b* is pulled out of the needle eye 21*a* at a high speed so that the thread hung to the threading hook 4*b* may have no time to slip out from the threading hook 4*b*. The threading shaft 2 is moved up along the guide groove 7 until the same comes to the upper initial position. Thus the threading operation is finished as shown in FIG. 16 ⑧. Such series of threading operations may be visualized at the display 23 of the sewing machine.

Thus according to the invention for passing a thread through the needle eye 21*a*, with operation of a button or lever, the threading shaft is axially rotated to swingingly rotate the threading hook 4*b* as is required, thereby to insert the same through the needle eye 21*a* and maintain the inserted state for preparation of threading operation for hanging the thread to the threading hook 4*b*. The invention will enable the machine operator to smoothly and rapidly perform a series of operations for passing the thread through the needle eye irrespectively of the experience of the machine operator.

The invention being thud described, it will be obvious that the same may be varied in many ways. Such variations are not to be regarded as a departure from the spirit and scope of the invention, and all such modifications are intended to be included within the scope of the following claims.

What is claimed is:

1. A sewing machine having a threading device having a vertically reciprocating needle bar having a needle attached to the lower end thereof, the needle having a needle eye through which a thread is to be passed, said sewing machine comprising:

(a) a threading member supported on a machine frame and being vertically and rotatingly movable;

(b) a hook provided at one end of said threading member and rotated in association with rotation of said threading member to pass through said needle eye for threading operation;

(c) means for maintaining a position of said hook corresponding to a vertically upper position of said needle bar as a threading position, where said hook is rotated in association with rotation of said threading member to pass through said needle eye as in required for threading operation.

2. A sewing machine having a threading device having a vertically reciprocating needle bar having a needle attached to the lower end thereof, the needle having a needle eye through which a thread is to be passed, said sewing machine comprising:

(a) a threading member supported on a machine frame and being vertically and rotatingly movable;

(b) a hook provided at one end of said threading member and being rotated in association with rotation of said threading member to pass through said needle eye of the needle for threading operation;

(c) means for maintaining a position of said threading member corresponding to a vertically upper position of said needle bar as a threading position and a position of said hook where said hook is rotated at said threading position in association with rotation of said threading member to pass through said needle eye as is required for threading operation.

3. A sewing machine having a threading device having a vertically reciprocating needle bar having a needle attached to the lower end thereof, the needle having a needle eye through which a thread is to be passed, said sewing machine comprising:

(a) a threading member supported on a machine frame and being vertically and rotatingly movable;

(b) a hook provided at one end of said threading member and being rotated in association with rotation of said threading member to pass trough said needle eye of the needle for threading operation;

(c) a drive motor for moving down said threading member to a threading position corresponding to a vertically upper position of said needle bar;

(d) guide means for rotating said threading member at said threading position in cooperation with said drive motor to pass said hook through said needle eye as is required for threading operation;

wherein said drive motor is controlled to maintain the position of said threading member where said hook is passed through said needle eye as is required for threading operation.

4. The sewing machine as defined in claim 3, wherein said drive motor is driven so as to pull said hook out of said needle eye at a higher speed than the speed at the time of inserting said hook through said needle eye.

5. The sewing machine as defined in claim 3, wherein said drive motor may be controlled so as to be stopped as is required for threading operation.

6. The sewing machine as defined in claim 3, wherein said drive motor may be stopped in case an excessive load is produced during vertical movement of said threading member.

7. The sewing machine as defined in claim 3, wherein said threading member has a thread cutter provided at a position thereof spaced from said hook with a predetermined distance provided therebetween.

8. A sewing machine having a threading device having a vertically reciprocating needle bar having a needle attached to the lower end thereof, the needle having a needle eye through which a thread is to be passed, said sewing machine comprising:

(a) a threading member supported on a machine frame and being vertically and rotatingly movable;

(b) a frame fixedly connected to said machine frame and is provided with a first guide for regulating the rotation of said threading member during vertical movement thereof and a second guide for allowing the rotation of said threading member during vertical movement thereof;

(c) a guide member for vertically moving said threading member along said first and second guides;

(d) a regulating member for regulating a threading position of said threading member;

(e) a drive motor operatively connected to said guide member to vertically move the same and for rotating said threading member as is required for threading operation in cooperation with said guide member at said threading position.

9. The sewing machine as defined in claim 8, wherein said drive motor rotates said threading member as is required for threading operation in cooperation with said guide member when one end of said threading member engages said regulating member.

10. The sewing machine as defined in claim 2 wherein said drive motor is driven so as to pull said hook out of said needle eye at a higher speed than the speed at the time of inserting said hook through said needle eye.

11. The sewing machine as defined in claim 2 wherein said drive motor may be controlled so as to be stopped as is required for threading operation.

12. The sewing machine as defined in claim 2 wherein said drive motor may be stopped in case an excessive load is produced during vertical movement of said threading member.

13. The sewing machine as defined in claim 12, further comprising a means for indicating a warning in case said drive motor is stopped.

14. The sewing machine as defined in claim 2 wherein said threading member has a thread cutter provided at a position thereof spaced from said hook with a predetermined distance provided there between.

* * * * *

UNITED STATES PATENT AND TRADEMARK OFFICE

CERTIFICATE OF CORRECTION

PATENT NO. : 6,564,731 B2
APPLICATION NO. : 09/919618
DATED : May 20, 2003
INVENTOR(S) : Yasuro Sano et al.

It is certified that error appears in the above-identified patent and that said Letters Patent is hereby corrected as shown below:

Col. 8, line 57 - Col. 9, line 6, delete Claim 1 and insert the following:

--1. A sewing machine having a threading device having a vertically reciprocating needle bar having a needle attached to the lower end thereof, the needle having a needle eye through which a thread is to be passed, said sewing machine comprising:

(a) a threading member supported on a machine frame and being vertically and rotatingly movable;

(b) a hook provided at one end of said threading member and rotated in association with rotation of said threading member to pass through said needle eye for threading operation;

(c) means for maintaining a position of said hook corresponding to a vertically upper position of said needle bar as a threading position, where said hook is rotated in association with rotation of said threading member to pass through said needle eye as in required for threading operation, wherein said means for maintaining a position of said hook is driven so as to pull said hook out of said needle eye at a higher speed than the speed at the time of inserting said hook through said needle eye.--

Col. 9, lines 7-25, delete Claim 2 and insert the following:

--2. A sewing machine having a threading device having a vertically reciprocating needle bar having a needle attached to the lower end thereof, the needle having a needle eye through which a thread is to be passed, said sewing machine comprising:

(a) a threading member supported on a machine frame and being vertically and rotatingly movable;

Signed and Sealed this
Twenty-seventh Day of November, 2012

David J. Kappos

David J. Kappos
*Director of the United States Patent and Trademark Office*

(b) a hook provided at one end of said threading member and being rotated in association with rotation of said threading member to pass through said needle eye of the needle for threading operation;

(c) means for maintaining a position of said threading member corresponding to a vertically upper position of said needle bar as a threading position and a position of said hook where said hook is rotated at said threading position in association with rotation of said threading member to pass through said needle eye as is required for threading operation, wherein said means for maintaining a position of said threading member may be controlled so as to be stopped as is required for threading operation.--

UNITED STATES PATENT AND TRADEMARK OFFICE

CERTIFICATE OF CORRECTION

PATENT NO. : 6,564,731 B2
APPLICATION NO. : 09/919618
DATED : May 20, 2003
INVENTOR(S) : Sano et al.

It is certified that error appears in the above-identified patent and that said Letters Patent is hereby corrected as shown below:

PLEASE DELETE PATENT 6,564,731 IN ITS ENTIRETY AND INSERT PATENT 6,564,731 IN ITS ENTIRETY AS ATTACHED.

Signed and Sealed this
Twenty-sixth Day of February, 2013

Teresa Stanek Rea
*Acting Director of the United States Patent and Trademark Office*

(12) United States Patent
Sano et al.

(10) Patent No.: US 6,564,731 B2
(45) Date of Patent: May 20, 2003

(54) SEWING MACHINE HAVING A THREADING DEVICE

(75) Inventors: Yasuro Sano, Tokyo (JP); Eiji Murakami, Tokyo (JP); Koshiro Omiya, Tokyo (JP)

(73) Assignee: Janome Sewing Machine Co., Ltd., Tokyo (JP)

( * ) Notice: Subject to any disclaimer, the term of this patent is extended or adjusted under 35 U.S.C. 154(b) by 0 days.

(21) Appl. No.: 09/919,618

(22) Filed: Aug. 1, 2001

(65) Prior Publication Data

US 2002/0073904 A1 Jun. 20, 2002

(30) Foreign Application Priority Data

Aug. 3, 2000 (JP) ..... 2000-236292
Nov. 30, 2000 (JP) ..... 2000-366159

(51) Int. Cl.[7] ..... D05B 87/02
(52) U.S. Cl. ..... 112/225
(58) Field of Search ..... 112/222, 224, 112/225; 223/99

(56) References Cited

U.S. PATENT DOCUMENTS 5,086,718 A * 2/1992 Ogawa ..... 112/225
5,086,719 A * 2/1992 Ogawa ..... 112/221
5,090,345 A * 2/1992 Ogawa ..... 112/225

* cited by examiner

*Primary Examiner*—Ismael Izaguirre
(74) *Attorney, Agent, or Firm*—Lowe Hauptman Gilman & Berner, LLP

(57) ABSTRACT

A sewing machine having a threading device is disclosed. The sewing machine comprises a needle bar having a needle attached to a lower end thereof. The needle has a needle eye and a threading shaft has a threading member mounted to the lower end thereof. The threading member has a threading hook, a drive motor for vertically moving the threading shaft along the needle bar, guide means for guiding and rotating the threading shaft at a threading position as the threading shaft is vertically moved, and a regulating member for deciding the threading position of the threading shaft. The threading shaft is moved down and stopped at the threading position and is axially rotated to pass the threading hook through the needle eye. The threading shaft is maintained in this state until a return signal is given such that the drive motor is driven again to pull the threading hook out of the needle eye and move up the threading shaft.

14 Claims, 14 Drawing Sheets

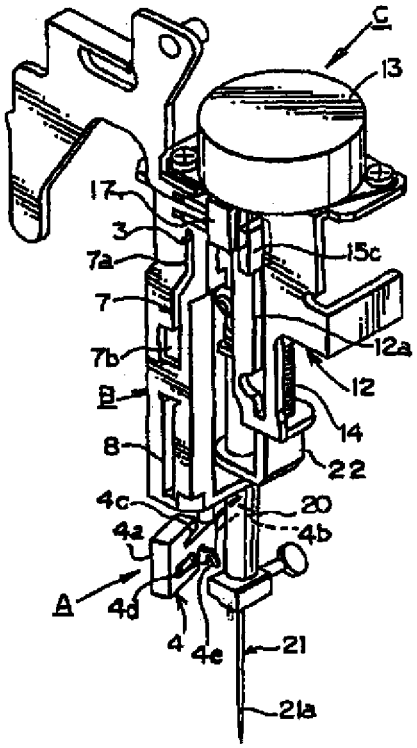

①Insert the thread into the guide on the needle bar.

②Lead the thread to the right side guide of threading member.

③Lead the thread to the left side guide of threading member.

④Insert the thread into the guide of threading member.

⑤Cut the thread with the cutter. ⑥The threading member is turned back.

⑦The threading member is moved up. ⑧The threading member is moved up.

SEWING MACHINE HAVING A THREADING DEVICE

BACKGROUND OF THE INVENTION AND RELATED ART STATEMENT

1. Field of the Invention

The present invention relates to a sewing machine, and more particularly relates to a threading device provided in connection with the sewing machine and including a threading member having a hook and vertically moved by a drive motor along a needle bar of the sewing machine. The threading member is moved down to a threading position and is then rotated to insert the hook through the needle eye of the needle which is attached to the lower end of the needle bar, wherein a series of threading operations may be smoothly and accurately.

2. Prior Art

Recently many sewing machines have come to be provided with a threading device. Various types of threading devices have been developed, and many of which include a threading member which is moved down near the needle eye of the needle and is then a hook is inserted through the needle eye. The series of threading operations are performed manually by manipulation of a lever.

Therefore, according to the prior art, it is required that the manually operated lever is held by hand until the thread is passed through the needle eye. In this case, the timing to release the lever or the force applied to the lever is inappropriate, the thread fails to pass through the needle eye. Further, the hook is often knocked against the needle instead of being inserted into the needle eye, and both may be damaged.

OBJECTS OF THE INVENTION

It is, therefore, a primary object of the invention to provide a threading device for a sewing machine which is compact in structure and smooth in operation.

It is another object of the invention to provide a threading device which is operated automatically by a drive motor such that a thread may be rapidly and accurately passed through the needle eye of needle irrespectively of the experience of the machine operator.

It is another object of the invention to provide a drive motor which may be controlled to pull a threading hook out of the needle eye at a higher speed than the speed at the time of inserting the threading hook through so that the thread hung to the inserted hook may not be slipped out.

It is another object of the invention to provide a drive motor which may be controlled to maintain the threading hook as it is inserted through the needle eye until a return signal is given.

It is another object of the invention to provide a drive motor which may be stopped to stop the operation of the threading device in case a trouble including an excessive load is detected during threading operation.

It is another object of the invention to provide a means for indicating a warm in case a trouble is produced.

It is another object of the invention to provide a cutter for cutting the thread passed through the needle eye with a predetermined length of thread remained that is sufficient enough to form the subsequent stitch without being pulled out of the needle eye.

The other objects and advantages of the invention will be apparent in the detailed description of the invention.

SUMMARY OF THE INVENTION

For attaining the objects, the invention substantially comprises a needle bar having a needle attached to the lower end thereof, the needle having a needle eye, a threading shaft having a threading member mounted to the lower end thereof, the threading member having a threading hook, a drive motor for vertically moving the threading shaft along the needle bar, guide means for guiding and rotating the threading shaft at a threading position as the same is vertically moved, a regulating member for deciding the threading position of the threading shaft, wherein the threading shaft is moved down and stopped at the threading position and is axially rotated to pass the threading hook through the needle eye and is maintained in this state until a return signal is given such that the drive motor may be driven again to pull the threading hook out of the needle eye and move up the threading shaft.

BRIEF DESCRIPTION OF THE DRAWINGS

FIG. 1

(*a*) is a perspective view of a threading device according to the invention.

(*b*) is same with (a), but is shown with a drive portion removed.

FIG. 2

(*a*) is a front elevational view of the threading device, wherein a threading shaft is in the upper inoperative position.

(*b*) is a side elevational view of the threading device shown partly in vertical section.

FIG. 3 is a plan elevational view of the essential parts of the threading device shown partly in horizontal section.

FIG. 4 is a side elevational view of the essential parts of the threading device.

FIG. 5

(*a*) and (*b*) are perspective views respectively of the essential parts of the threading device.

(*c*) is a plan elevational view of the essential parts of the threading device shown partly in horizontal section.

FIG. 6

(*a*) is a side elevational view of the essential parts of the threading device shown partly in vertical section.

(*b*) is a rear side view of (a).

FIG. 7

(*a*) and (*b*) are front elevational views respectively of the essential parts of the threading device showing the operation thereof shown partly cut out to show the inside thereof.

FIG. 8

(*a*) is a front elevational view of the essential parts of the threading device showing a phase of operation thereof.

(*b*) is a plan elevational view of the essential parts of the threading device shown partly in horizontal section showing a phase of operation thereof.

(*c*) is a plan elevational view of the essential parts of the threading device showing a phase of operation thereof.

FIG. 9

(*a*), (*b*) and (*c*) are same with FIG. 8 (*a*), (*b*) and (*c*) respectively but showing another phase of operation thereof.

FIG. 10

(*a*), (*b*) and (*c*) are same with FIG. 9 (*a*), (*b*) and (*c*) respectively but showing another phase of operation thereof.

FIG. 11

(*a*) is a perspective view of the threading device showing the operation thereof.

(*b*), (*c*) and (*d*) are side elevational views respectively of the threading device shown partly in vertical section and showing a series of operation phases thereof.

FIG. 12

(*a*), (*b*) and (*c*) are front elevational views respectively of the threading device showing a series of operation phases thereof.

FIG. 13

(*a*) is a perspective view of the threading device showing a phase of operation thereof.

(*b*) is an enlarged perspective view of a part of (*a*).

FIG. 14

(*a*) is a perspective view of a sewing machine having the threading device incorporated therein.

(*b*) is an enlarged front elevational view of an essential part of the threading device.

FIG. 15

① through ④ are perspective views respectively of the essential parts of the threading device showing a series of operations thereof.

FIG. 16

⑤ through ⑧ are same with FIG. 15 ① through ④ but showing another series of operation phases thereof.

FIG. 17

(*a*) is a side elevational view of another embodiment of the threading device according to the invention shown partly in vertical section.

(*b*) through (*d*) are side elevational views respectively of a part of (a) showing a series of operation phases thereof.

DETAILED DESCRIPTION OF PREFERRED EMBODIMENTS

The invention will be described in detail in reference to the preferred embodiments as shown in the attached drawings. As shown in FIGS. 1(*a*), (*b*) and FIGS. 2(*a*), (*b*), the subject matter of the invention substantially composed of a threading portion A, a support B and an up-down drive portion C. The threading portion A is supported on the support portion B which is mounted to a needle support frame 22 of a sewing machine (not shown). The threading portion A includes a threading shaft 2, a guide pin 3 and a threading member 4 having a threading hook 4*b*. The invention further includes a sensor for detecting a lower stop position of the threading member 4 and a rotary means for inserting the threading hook 4*b* into a needle eye 21*a* of a needle 21 attached to the lower end of a needle bar 20.

The guide pin 3 is inserted through the threading shaft 2 transversely thereof and is fixed thereto and has the opposite ends protruded radially of the threading shaft 2 as shown in FIG. 2(*b*) and FIGS. 5(*a*), (*b*). The guide pin 3 is moved up and down by an up-down guide member 9 which is operatively connected to the up-down drive portion C, and thus the threading shaft 2 is vertically moved as will be described in detail hereinlater.

The threading member 4 includes a swingable member 4*a* carrying the threading hook 4*b*. The swingable member 4*a* is fixed to the lower end of he threading shaft 2 and is swingingly moved with rotation of the threading shaft 2 in the circumferential direction thereof. Thus the threading hook 4*b* carried by the swingable member 4*a* is inserted into the needle eye 21*a* to pass a thread through the needle eye 21*a*.

The guide pin 3 and the swingable member 4*a* are arranged with a predetermined angled provided therebetween, and a thread cutter 4*c* is formed at the swingable member 4*a* with a predetermined distance provided from the threading hook 4*b*. The predetermined distance L (FIG. 16 ①) between the threading hook 4*b* and the thread cutter 4*c* is decided in consideration of the length of spare thread to remain after being passed and cut, such that the spare thread will not come out of the needle eye 21*a* at the time of the subsequent stitch formation. By the way, it is effective to form a thread holder 4*d* at the thread cutter 4*c* for holding the thread with a mild force on the side facing the needle eye 21*a*. It is further effective to provide a thread guide 4*e* as shown in FIG. 5(*a*).

As shown in FIG. 1 and FIGS. 2(*a*), (*b*), the support portion B includes a frame member 6 having a vertical side wall 6*a* formed with a guide groove 7 of cam type and having upper and lower horizontal walls 6*b*, 6*b* for supporting the threading shaft 2. The guide pin 3 has one end engaging the guide groove 7 so that the guide pin 3 may be vertically moved along the guide groove 7 as is guided thereby.

The threading shaft 2 has a coil spring 5 provided therearound. The coil spring 5 has the upper end pressed against the guide pin 3 and the lower end pressed against the lower horizontal wall 6*b* of the frame member 6 as shown in FIG. 2(*b*) so that the threading shaft 2 may be normally urged in the upper direction.

As shown in FIG. 2(*a*), the guide groove 7 includes an upper groove 7*a* for guiding the vertical movement of guide pin 3 and a lower groove 7*b* for guiding the rotary movement of guide pin 3, the upper and lower grooves 7*a*, 7*b* being continuous. The upper groove 7*a* further includes a vertical groove portion 7*a*, for preventing the guide pin 3 from being rotated in the horizontal plane and an angularly inclined groove portion $7a_2$ for allowing the guide pin 3 to rotate in the horizontal plane, the both groove portions $7a_1$, $7a_2$ being continuous and the latter extending from the former as is slightly inclined.

The angularly inclined groove portion $7a_2$ for is provided to slightly rotate the guide pin 3, thereby to slightly rotate the threading shaft 2 and the threading member 4, so that the threading member 4 may move round a projection such as a needle bar holder which is located on the needle bar 20 near the path through which the threading member is vertically moved.

The lower groove 7*b* has a generally rectangular opening of a space for allowing the rotary movement of guide pin 3 in cooperation with a regulating member 18 as will be described in detail hereinlater.

As shown in FIGS. 5(*a*) through (*c*), the up-down guide member 9 is provided to vertically move the threading shaft 2 through the guide pin 3. The up-down guide member 9 is generally semicircular in horizontal section having a wall 9*a* forming an axially extending hole $9a_1$. The up-down guide member 9 has an inclined groove 9*b* formed at the wall 9*a* thereof for receiving a part of the guide pin 3 as is extended therethrough transversely of the guide member 9 and partly protruded out thereof as shown in FIG. 2(*b*). The guide member 9 is axially mounted to the thread shaft 2 as is movable axially thereof. The up-down guide member 9 further has a radial extension 9*c*. The guide pin 3 has the opposite end passing through the inclined groove 9*b*.

The projection 9*c* is operatively connected to a drive member 15 of the up-down drive portion C as will be described in detail hereinlater. Further, the projection 9*c* is partly in contact with the width end of the vertical wall 6*a* of the frame member 6 to regulate the rotation of the up-down guide member 9 in the circumferential direction thereof as shown in FIG. 9(*b*) and FIG. 10(*b*).

The guide member 9 has an axially extending part 9*d* formed at the lower end thereof and the frame member 6 has a vertical groove 8 formed at the vertical wall 6*a* thereof, the vertical groove 8 being formed at a position downwardly of the guide groove 7 as shown in FIGS. 2(*a*) and (*b*), so that the axial extending part 9*d* may be inserted into the vertical groove 8 when the guide member 9 is moved down to move the guide pin 3 to the lower end of the vertical groove portion $7a_1$, that is just before the rotation guide groove 7*b*. Under the circumstances, when the guide pin 3 comes in the range of the rotation guide groove 7*b*, the guide member 9 is prevented from rotation and is movable only in the vertical direction.

The up-down drive portion C substantially includes a frame 12, a drive motor 13, a threaded shaft 14 and the aforementioned drive member 15. The drive motor 13 is mounted on the frame 12 which is mounted to the support portion B as shown in FIG. 1(*a*) and FIGS. 6(*a*) and (*b*). Preferably the drive motor 13 is a stepping motor which may correctly control the angular positions of the threaded shaft 14.

The drive motor 13 is directly connected to the threaded shaft 14 to rotate the same. The threaded shaft 14 is in threaded engagement with the axially threaded hole $15a_1$ of the base 15*a* of the drive member 15. Thus the threaded shaft 14 is rotated to move the drive member 15 axially thereof as shown in FIGS. 6(*a*) and (*b*). The drive member is operatively connected to the guide member 9 to vertically move the same.

The drive member 15 is provided with a radially extending recessed arm 15*b* which is in engagement with the projection 9*c* of the guide member 9 as receiving the same, wherein the projection 9*a* may be moved in the horizontal plane as shown in FIG. 4.

The frame 12 has a vertical guide groove 12*a* formed thereat which is in engagement with a radial projection 15*c* of the drive member 15 so that the drive member 15 may be vertically moved in a stabilized condition as is guided by the guide groove 12*a*.

A sensor is provided for detecting a lower stop position of the threading member 4 and another pressure sensor for detecting the trouble of the threading member 4. Precisely, the drive member 15 is provided with a pressure sensor 16 which detects the lower region of the threading member 4 and the subsequent rotation of the drive motor 13 which is required to rotate the threading hook 4*b* for threading in the rotary region. Further, the pressure sensor is provided to stop the drive motor 13 in case the threading member 4 is involved with the troubles including excessive load applied thereto wherein something foreign is attached or stuck to the threading member 4, thereby to prevent the damage of the threading member 4 and/or the needle 21.

More precisely, as shown in FIG. 6(*b*), FIGS. 7(*a*) and (*b*), the pressure sensor 16 having an actuator 16*a* and a movable member 15*d* having an extension $15d_1$ are mounted to the base 15*a* of the drive member 15 so as to be moved together with the drive member 15. The movable member 15*d* is connected to the drive member 15 and is normally pressed down a coil spring 15*e* so that the movable member 15*d* may be moved up and down relative to the actuator 16*a* of the pressure sensor 16 in association with the up and down movement of the drive member 15, thereby to make the pressure sensor 16 on or off.

With this structure, the drive member 15 is moved down with rotation of the threaded shaft 14 and the guide member 9 is moved down in association with the movement of the drive member 15. In case some external force is exerted to the threading member 4 to forcibly stop the same, the movable member 15*d* is moved up against the action of the coil spring 15*e* to activate the actuator 16*a*, because the movable member 15*d* is operatively connected to the guide member 9 through the radially extending recessed arm 15*b* of the drive member 15 and the radial extension 9*c* of the guide member. Then the pressure sensor 16 detects that the threading member 4 has passed the descending region, and in the subsequent rotation region, reduces the rotation speed of the drive motor 13 so as to operate the threading hook 4*b* relative to the needle 21 without interference with the needle 21.

As shown in FIG. 1(*a*) and (*b*), the needle bar 20 is supported by a support frame 22 which is fixedly connected to a sewing machine frame (not shown). The needle bar 20 is slidingly movable in the vertical direction relative to the support frame 22. The needle 21 having the needle eye 21*a* is removably attached to the lower end of the needle bar 20. The needle bar 20 is provided with a regulating member 18. The regulating member 18 is in a form of elongated hollow shaft and is in axially fixed engagement with the needle bar 20.

The regulating member 18 is formed with a laterally extending forked portion having upper and lower extensions 18*a*, 18*b*, the upper extension 18*b* having a regulating surface and the lower extension having a slide surface which may engage the inner end of the guide pin 13 and allows the rotation of the guide pin 13 in horizontal plane so that the threading hook 4*b* of the threading member 4 may be rotated through the threading shaft 2 to pass a thread through the needle eye 21*a* as shown in FIG. 2(*b*). The upper extension 18*b* is located at the position that is one end of the region where the guide pin 3 may slide as shown in FIG. 11(*a*).

With the guide pin 3 being held between the upper and lower extensions 18*a*, 18*b* of the regulating member 18 as shown in FIGS. 11(*c*) and (*d*), the descending movement of the threading shaft 2 and the threading member 4 may be stopped by the regulating member 18. Further, in case a power failure is happened while the guide pin 3 is being rotated, the threading shaft 2 may be prevented from being moved up by the action of he coil spring 5.

Here, as shown in FIG. 2(*b*), it is required that the distance $H_1$ between the guide pin 13 of he threading shaft 2 and the threading hook 4*b* of the threading member 4 provided and the distance $H_2$ between the slide surface 18*a* of the regulating member 18 and the needle eye 21*a* of the needle 21 are identical, that is, $H_1=H_2$. Therefore, the position of the regulating member may be adjusted to satisfy the requirement as to the distance.

As shown in FIGS. 14(*a*) and (*b*), a display 23 is provided at the sewing machine. The display 23 is operated by operation of a threading switch to indicate the threading instructions which are stationary or movable as shown in FIGS. 15 ①, ②, ③, ④ and FIGS. 16 ⑤, ⑥, ⑦, ⑧. The display 23 further indicates a prohibition of threading operation during stitching operation and vice versa.

According to the invention, the guide pin 3 may be normally pressed down by a compression spring 10 provided between the guide member 9 and the guide pin 3 as shown in FIGS. 17(*a*), (*b*), the compression spring 10 being of a force stronger than the coil spring 5. In this case it is preferable that the upper end of coil spring 5 is pressed against the lower end 9*e* of the guide member 9.

The up-down guide member 9 may be moved down with descending movement of he drive member 15. As the inner end of the guide pin 3 comes to contact the slide surface 18*a* of the regulating member 18, the guide member is then moved down against the action of the compression spring 10 as is axially rotated along the inclined groove 9*b* thereof as shown in FIGS. 17(*c*), (*d*). Therefore, the threading shaft 2 is axially rotated accordingly to rotate the threading member 4. Thus the threading hook 4*b* is inserted into the needle eye 21*a* to pass a thread through the needle eye 21*a* with subsequent pullback of the threading hook 4*b*. In case the guide member 9 is moved up with ascending movement of the drive member 15, the compression spring 10 acts as to press down the guide pin 3 along the inclined groove 9*b* of the guide member 9. The guide pin 3 is, therefore, moved down along the inclined groove 9*b* instantly when the guide member 9 starts to ascend. As the result, the threading shaft 2 and accordingly the threading member 4 is axially rotated in the opposite direction, and the threading hook 4*b* is pulled out of the needle eye 21*a*. Thus the series of operations may be smoothly performed.

Operation is as follows:

Prior to threading operation, it is required that the needle bar 20 is an upper position. In the initial stage, the guide pin 3 is positioned at the upper end of the guide groove 7 as shown in FIG. 8(*a*). The drive motor 13 is driven by operation of a switch (not shown) to rotate the threaded shaft 14.

With rotation of the threaded shaft 14, the drive member 15 is moved down along the threaded shaft 14 as shown in FIG. 6. Simultaneously a limit switch 17 is operative to confirm the movement of the drive member 15. As the drive member 15 is moved down, the guide member 9 is move down through the connection arm 15*b* of the drive member 15.

The descending movement of the guide member 9 is transmitted to the threading shaft 2 through the guide pin 3. The guide pin 13 is moved down along the guide groove 7. As the guide pin 3 comes to the range of the angle changing groove $7a_2$ as shown in FIGS. 9(*a*) and (*b*), the threading shaft 2 starts axial rotation so that the threading member 4 may be moved down avoiding the needle holder for fixedly mounting the needle 21 to the lower end of the needle bar 20.

As the drive member 15 is further moved down, the guide pin 13 comes to the region of rotation guide groove 7*b*. In the region of vertical groove $7a_1$ just before the rotation guide groove 7*b*, the opposite end of he guide pin 3 comes to contact the slide surface 18*a* of the regulating member 18 to stop the movement of the threading shaft 2 and the threading member 4 accordingly as shown in FIGS. 10 through 12. In his case, the positions of the threading hook 4*b* and of the needle eye 21*a* are on the same level.

With the subsequent descending movement of the guide member 9, the threading shaft 2 is axially rotated as the guide pin 3 is rotated as is guided along the inclined groove 9*b* of the guide member 9. The load resistance at the time of rotation of the threading shaft 2 is higher than the one at the time of descending movement of the threading shaft 2 drive member 15. Namely the load resistance is higher than the reacting force of the coil spring 15*e* arranged at the drive member 15. Therefore, when the guide pin 3 comes to the rotation region from the descending region where the guide pin 3 contacts the regulating member 18, the drive member 15 is stopped as is moved against the action of the coil spring 5*e*.

The movable member 15 is operated to move up the actuator 16*a* of the pressure sensor 16, thereby to activate the pressure sensor 16 to detect the descend end position. Subsequently the drive motor 13 is rotated to a certain amount as is required. Such predetermined rotation amount of the drive motor 13 will further move down the guide member 9 to rotate the guide pin 3 through the inclined groove 9*b*, thereby to axially rotate the threading shaft 2 and the threading hook 4*b* accordingly. Thus the threading hook 4*b* is inserted through the needle eye 21*a* of the needle 20 as shown in FIGS. 13(*a*) and (*b*). In this condition, the drive motor 13 is stopped with maintaining current being supplied until the subsequent ascend signal is given.

Subsequently, the thread extending from the thread supply (not shown) to be passed through the needle eye 21*a* is hung to the threading hook 21*a* as shown in FIGS. 15 ① through ④. The free end portion of the thread is then hung to the thread holding member 4*d* and is cut off by pressingly contacting the thread against the thread cutter 4*c* was shown in FIGS. 16 ⑤ and ⑥. The distance between the thread cutter 4*c* and the needle eye 21*a* is decided to correspond to the length of thread which is sufficient to be supplied to form the subsequent stitch without being pulled out of the needle eye 21*a*.

When the thread is cut off, a returning signal is produced to move up the threading member 4. Then the drive motor 13 is rotated in the opposite direction in response to the returning signal to axially rotate the threading shaft 2 while the guide pin 3 is moved along the inclined groove 9*b* of the guide member 9, thereby to pull the threading hook 4*b* out of the needle eye 21*a* as shown in FIGS. 16 ⑥ and ⑦.

Preferably the threading hook 4*b* is pulled out of the needle eye 21*a* at a high speed so that the thread hung to the threading hook 4*b* may have no time to slip out from the threading hook 4*b*. The threading shaft 2 is moved up along the guide groove 7 until the same comes to the upper initial position. Thus the threading operation is finished as shown in FIG. 16 ⑧. Such series of threading operations may be visualized at the display 23 of the sewing machine.

Thus according to the invention for passing a thread through the needle eye 21*a*, with operation of a button or lever, the threading shaft is axially rotated to swingingly rotate the threading hook 4*b* as is required, thereby to insert the same through the needle eye 21*a* and maintain the inserted state for preparation of threading operation for hanging the thread to the threading hook 4*b*. The invention will enable the machine operator to smoothly and rapidly perform a series of operations for passing the thread through the needle eye irrespectively of the experience of the machine operator.

The invention being thud described, it will be obvious that the same may be varied in many ways. Such variations are not to be regarded as a departure from the spirit and scope of the invention, and all such modifications are intended to be included within the scope of the following claims.

What is claimed is:

1. A sewing machine having a threading device having a vertically reciprocating needle bar having a needle attached to the lower end thereof, the needle having a needle eye through which a thread is to be passed, said sewing machine comprising:

(a) a threading member supported on a machine frame and being vertically and rotatingly movable;

(b) a hook provided at one end of said threading member and rotated in association with rotation of said threading member to pass through said needle eye for threading operation;

(c) means for maintaining a position of said hook corresponding to a vertically upper position of said needle bar as a threading position, where said hook is rotated in association with rotation of said threading member to pass through said needle eye as in required for threading operation, wherein said means for maintaining a position of said hook is driven so as to pull said hook out of said needle eye at a higher speed than the speed at the time of inserting said hook through said needle eye.

2. A sewing machine having a threading device having a vertically reciprocating needle bar having a needle attached to the lower end thereof, the needle having a needle eye through which a thread is to be passed, said sewing machine comprising:

(a) a threading member supported on a machine frame and being vertically and rotatingly movable;

(b) a hook provided at one end of said threading member and being rotated in association with rotation of said threading member to pass through said needle eye of the needle for threading operation;

(c) means for maintaining a position of said threading member corresponding to a vertically upper position of said needle bar as a threading position and a position of said hook where said hook is rotated at said threading position in association with rotation of said threading member to pass through said needle eye as is required for threading operation, wherein said means for maintaining a position of said threading member may be controlled so as to be stopped as is required for threading operation.

3. A sewing machine having a threading device having a vertically reciprocating needle bar having a needle attached to the lower end thereof, the needle having a needle eye through which a thread is to be passed, said sewing machine comprising:

(a) a threading member supported on a machine frame and being vertically and rotatingly movable;

(b) a hook provided at one end of said threading member and being rotated in association with rotation of said threading member to pass through said needle eye of the needle for threading operation;

(c) a drive motor for moving down said threading member to a threading position corresponding to a vertically upper position of said needle bar;

(d) guide means for rotating said threading member at said threading position in cooperation with said drive motor to pass said hook through said needle eye as is required for threading operation;

wherein said drive motor is controlled to maintain the position of said threading member where said hook is passed through said needle eye as is required for threading operation.

4. The sewing machine as defined in claim 3, wherein said drive motor is driven so as to pull said hook out of said needle eye at a higher speed than the speed at the time of inserting said hook through said needle eye.

5. The sewing machine as defined in claim 3, wherein said drive motor may be controlled so as to be stopped as is required for threading operation.

6. The sewing machine as defined in claim 3, wherein said drive motor may be stopped in case an excessive load is produced during vertical movement of said threading member.

7. The sewing machine as defined in claim 3, wherein said threading member has a thread cutter provided at a position thereof spaced from said hook with a predetermined distance provided therebetween.

8. A sewing machine having a threading device having a vertically reciprocating needle bar having a needle attached to the lower end thereof, the needle having a needle eye through which a thread is to be passed, said sew machine comprising:

(a) a threading member supported on a machine frame and being vertically and rotatingly movable;

(b) a frame fixedly connected to said machine frame and is provided with a first guide for regulating the rotation of said threading member during vertical movement thereof and a second guide for allowing the rotation of said threading member during vertical movement thereof;

(c) a guide member for vertically moving said threading member along said first and second guides;

(d) a regulating member for regulating a threading position of said threading member;

(e) a drive motor operatively connected to said guide member to vertically move the same and for rotating said threading member as is required for threading operation in cooperation with said guide member at said threading position.

9. The sewing machine as defined in claim 4, wherein said drive motor rotates said threading member as is required for threading operation in cooperation with said guide member when one end of said threading member engages said regulating member.

10. The sewing machine as defined in claim 2 wherein said drive motor is driven so as to pull said hook out of said needle eye at a higher speed than the speed at the time of inserting said hook through said needle eye.

11. The sewing machine as defined in claim 2 wherein said drive motor may be controlled so as to be stopped as is required for threading operation.

12. The sewing machine as defined in claim 2 wherein said drive motor may be stopped in case an excessive load is produced during vertical movement of said threading member.

13. The sewing machine as defined in claim 12, further comprising a means for indicating a warning in case said drive motor is stopped.

14. The sewing machine as defined in claim 2 wherein said threading member has a thread cutter provided at a position thereof spaced from said hook with a predetermined distance provided there between.

* * * * *